US009093033B2

(12) United States Patent
Sakai et al.

(10) Patent No.: US 9,093,033 B2
(45) Date of Patent: Jul. 28, 2015

(54) IMAGE DISPLAY DEVICE AND IMAGE DISPLAY METHOD

(75) Inventors: Tamotsu Sakai, Osaka (JP); Yuhji Tanaka, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 646 days.

(21) Appl. No.: 13/386,089

(22) PCT Filed: Mar. 31, 2010

(86) PCT No.: PCT/JP2010/055806
§ 371 (c)(1),
(2), (4) Date: Jan. 20, 2012

(87) PCT Pub. No.: WO2011/013404
PCT Pub. Date: Feb. 3, 2011

(65) Prior Publication Data

US 2012/0139974 A1 Jun. 7, 2012

(30) Foreign Application Priority Data

Jul. 29, 2009 (JP) ..... 2009-176021

(51) Int. Cl.
*G09G 5/10* (2006.01)
*G09G 3/34* (2006.01)

(52) U.S. Cl.
CPC ..... *G09G 3/3426* (2013.01); *G09G 2320/0626* (2013.01); *G09G 2360/16* (2013.01)

(58) Field of Classification Search
CPC ..... G09G 3/3426; G09G 2360/16; G09G 2320/066; G09G 3/3648
USPC ..... 345/36, 37, 41, 44, 46, 50, 60, 73, 345/74.1–83, 87–104, 84; 362/27, 241, 362/244, 97.1–97.3
See application file for complete search history.

(56) References Cited

U.S. PATENT DOCUMENTS 7,106,321 B2 * 9/2006 Morita ..... 345/211
7,760,210 B2 * 7/2010 Plut ..... 345/690

(Continued)

FOREIGN PATENT DOCUMENTS

JP 2004-184937 A 7/2004
JP 2005258403 A 9/2005

(Continued)

OTHER PUBLICATIONS

International Search Report and Written Opinion of Searching Authority.

*Primary Examiner* — Priyank Shah
(74) *Attorney, Agent, or Firm* — Harness, Dickey & Pierce, P.L.C.

(57) ABSTRACT

A display position information acquisition section of an image display device outputs display position identification data for identifying a display position on the screen. An LED output value calculation section divides an input image into a plurality of areas and obtains LED data which is data for emission luminances of LEDs in the areas. At this time, emission luminances of LEDs in a non-display area are set to 0 on the basis of the display position identification data. A display luminance calculation section obtains display luminances of the areas based upon the emission luminances. A partial display correction filter generation section generates a partial display correction filter having correction data for each pixel stored therein, based upon the display position identification data. An LCD data calculation section obtains liquid crystal data based upon the input image, the display luminances, and the correction data.

14 Claims, 33 Drawing Sheets

(56) References Cited

U.S. PATENT DOCUMENTS

| | | | | |
|---|---|---|---|---|
| 2004/0233226 | A1* | 11/2004 | Toriumi et al. | 345/690 |
| 2005/0184952 | A1 | 8/2005 | Konno et al. | |
| 2006/0097974 | A1* | 5/2006 | Hashimoto et al. | 345/98 |
| 2006/0132474 | A1* | 6/2006 | Lam | 345/204 |
| 2006/0214904 | A1 | 9/2006 | Kimura et al. | |
| 2006/0227122 | A1* | 10/2006 | Proctor | 345/204 |
| 2006/0227125 | A1* | 10/2006 | Wong et al. | 345/211 |
| 2007/0024552 | A1* | 2/2007 | Shimizu et al. | 345/87 |
| 2008/0036753 | A1* | 2/2008 | Washio et al. | 345/212 |
| 2008/0079671 | A1* | 4/2008 | Yamazaki et al. | 345/82 |
| 2008/0284719 | A1* | 11/2008 | Yoshida | 345/102 |
| 2009/0009456 | A1 | 1/2009 | Ohshima | |
| 2009/0115720 | A1 | 5/2009 | Inada et al. | |
| 2009/0140975 | A1 | 6/2009 | Nonaka et al. | |
| 2010/0073276 | A1* | 3/2010 | Koike et al. | 345/102 |
| 2011/0037784 | A1* | 2/2011 | Shiomi | 345/690 |
| 2011/0115827 | A1* | 5/2011 | Tanaka | 345/690 |

FOREIGN PATENT DOCUMENTS

| | | | |
|---|---|---|---|
| JP | 2007034251 | A | 2/2007 |
| JP | 2008-304907 | A | 12/2008 |
| JP | 2009116012 | A | 5/2009 |
| JP | 2009139470 | A | 6/2009 |

* cited by examiner

Fig.5

104

| | | | | |
|---|---|---|---|---|
| 0 | 0 | 10 | 0 | 0 |
| 0 | 30 | 50 | 30 | 0 |
| 10 | 50 | 100 | 50 | 10 |
| 0 | 30 | 50 | 30 | 0 |
| 0 | 0 | 10 | 0 | 0 |

Fig.8

106

| | | | | | | | | | | | |
|---|---|---|---|---|---|---|---|---|---|---|---|
| 0.0 | 0.0 | 0.0 | 0.0 | 0.0 | 0.0 | 0.0 | 0.0 | 0.0 | 0.0 | 0.0 | 0.0 |
| 0.0 | 0.0 | 0.0 | 0.0 | 0.0 | 0.0 | 0.0 | 0.0 | 0.0 | 0.0 | 0.0 | 0.0 |
| 0.0 | 0.0 | 0.0 | 0.0 | 0.0 | 0.0 | 0.0 | 0.0 | 0.0 | 0.0 | 0.0 | 0.0 |
| 0.0 | 0.0 | 0.0 | 0.5 | 0.7 | 0.7 | 0.7 | 0.7 | 0.5 | 0.0 | 0.0 | 0.0 |
| 0.0 | 0.0 | 0.0 | 0.7 | 0.9 | 1.0 | 1.0 | 0.9 | 0.7 | 0.0 | 0.0 | 0.0 |
| 0.0 | 0.0 | 0.0 | 0.7 | 1.0 | 1.0 | 1.0 | 1.0 | 0.7 | 0.0 | 0.0 | 0.0 |
| 0.0 | 0.0 | 0.0 | 0.7 | 1.0 | 1.0 | 1.0 | 1.0 | 0.7 | 0.0 | 0.0 | 0.0 |
| 0.0 | 0.0 | 0.0 | 0.7 | 0.9 | 1.0 | 1.0 | 0.9 | 0.7 | 0.0 | 0.0 | 0.0 |
| 0.0 | 0.0 | 0.0 | 0.5 | 0.7 | 0.7 | 0.7 | 0.7 | 0.5 | 0.0 | 0.0 | 0.0 |
| 0.0 | 0.0 | 0.0 | 0.0 | 0.0 | 0.0 | 0.0 | 0.0 | 0.0 | 0.0 | 0.0 | 0.0 |
| 0.0 | 0.0 | 0.0 | 0.0 | 0.0 | 0.0 | 0.0 | 0.0 | 0.0 | 0.0 | 0.0 | 0.0 |
| 0.0 | 0.0 | 0.0 | 0.0 | 0.0 | 0.0 | 0.0 | 0.0 | 0.0 | 0.0 | 0.0 | 0.0 |

Fig.9

106

| | | | | | | | | | | | |
|---|---|---|---|---|---|---|---|---|---|---|---|
| 0.0 | 0.0 | 0.0 | 0.0 | 0.0 | 0.0 | 0.0 | 0.0 | 0.0 | 0.0 | 0.0 | 0.0 |
| 0.0 | 0.0 | 0.0 | 0.0 | 0.0 | 0.0 | 0.0 | 0.0 | 0.0 | 0.0 | 0.0 | 0.0 |
| 0.0 | 0.0 | 0.0 | 0.0 | 0.0 | 0.0 | 0.0 | 0.0 | 0.0 | 0.0 | 0.0 | 0.0 |
| 0.0 | 0.0 | 0.0 | 0.0 | 0.0 | 0.0 | 0.0 | 0.0 | 0.0 | 0.0 | 0.0 | 0.0 |
| 0.0 | 0.0 | 0.0 | 0.0 | 0.0 | 0.0 | 0.0 | 0.0 | 0.0 | 0.0 | 0.0 | 0.0 |
| 0.0 | 0.0 | 0.0 | 0.0 | 0.0 | 0.0 | 0.0 | 0.0 | 0.0 | 0.0 | 0.0 | 0.0 |
| 0.5 | 0.7 | 0.7 | 0.7 | 0.7 | 0.5 | 0.0 | 0.0 | 0.0 | 0.0 | 0.0 | 0.0 |
| 0.7 | 0.9 | 1.0 | 1.0 | 0.9 | 0.7 | 0.0 | 0.0 | 0.0 | 0.0 | 0.0 | 0.0 |
| 0.7 | 1.0 | 1.0 | 1.0 | 1.0 | 0.7 | 0.0 | 0.0 | 0.0 | 0.0 | 0.0 | 0.0 |
| 0.7 | 1.0 | 1.0 | 1.0 | 1.0 | 0.7 | 0.0 | 0.0 | 0.0 | 0.0 | 0.0 | 0.0 |
| 0.7 | 0.9 | 1.0 | 1.0 | 0.9 | 0.7 | 0.0 | 0.0 | 0.0 | 0.0 | 0.0 | 0.0 |
| 0.5 | 0.7 | 0.7 | 0.7 | 0.7 | 0.5 | 0.0 | 0.0 | 0.0 | 0.0 | 0.0 | 0.0 |

Fig.12

106

| | | | | | | | | | | | |
|---|---|---|---|---|---|---|---|---|---|---|---|
| 1.0 | 1.0 | 1.0 | 1.0 | 1.0 | 1.0 | 1.0 | 1.0 | 1.0 | 1.0 | 1.0 | 1.0 |
| 1.0 | 1.0 | 1.0 | 1.0 | 1.0 | 1.0 | 1.0 | 1.0 | 1.0 | 1.0 | 1.0 | 1.0 |
| 1.0 | 1.0 | 1.0 | 1.0 | 1.0 | 1.0 | 1.0 | 1.0 | 1.0 | 1.0 | 1.0 | 1.0 |
| 1.0 | 1.0 | 1.0 | 1.0 | 1.0 | 1.0 | 1.0 | 1.0 | 1.0 | 1.0 | 1.0 | 1.0 |
| 1.0 | 1.0 | 1.0 | 1.0 | 1.0 | 1.0 | 1.0 | 1.0 | 1.0 | 1.0 | 1.0 | 1.0 |
| 1.0 | 1.0 | 1.0 | 1.0 | 1.0 | 1.0 | 1.0 | 1.0 | 1.0 | 1.0 | 1.0 | 1.0 |
| 1.0 | 1.0 | 1.0 | 1.0 | 1.0 | 1.0 | 1.0 | 1.0 | 1.0 | 1.0 | 1.0 | 1.0 |
| 1.0 | 1.0 | 1.0 | 1.0 | 1.0 | 1.0 | 1.0 | 1.0 | 1.0 | 1.0 | 1.0 | 1.0 |
| 1.0 | 1.0 | 1.0 | 1.0 | 1.0 | 1.0 | 1.0 | 1.0 | 1.0 | 1.0 | 1.0 | 1.0 |
| 1.0 | 1.0 | 1.0 | 1.0 | 1.0 | 1.0 | 1.0 | 1.0 | 1.0 | 1.0 | 1.0 | 1.0 |
| 1.0 | 1.0 | 1.0 | 1.0 | 1.0 | 1.0 | 1.0 | 1.0 | 1.0 | 1.0 | 1.0 | 1.0 |
| 1.0 | 1.0 | 1.0 | 1.0 | 1.0 | 1.0 | 1.0 | 1.0 | 1.0 | 1.0 | 1.0 | 1.0 |

Fig.13

106

| | | | | | | | | | | | |
|---|---|---|---|---|---|---|---|---|---|---|---|
| 0.5 | 0.7 | 0.7 | 0.7 | 0.7 | 0.7 | 0.7 | 0.7 | 0.7 | 0.7 | 0.7 | 0.5 |
| 0.7 | 0.9 | 1.0 | 1.0 | 1.0 | 1.0 | 1.0 | 1.0 | 1.0 | 1.0 | 0.9 | 0.7 |
| 0.7 | 1.0 | 1.0 | 1.0 | 1.0 | 1.0 | 1.0 | 1.0 | 1.0 | 1.0 | 1.0 | 0.7 |
| 0.7 | 1.0 | 1.0 | 1.0 | 1.0 | 1.0 | 1.0 | 1.0 | 1.0 | 1.0 | 1.0 | 0.7 |
| 0.7 | 1.0 | 1.0 | 1.0 | 1.0 | 1.0 | 1.0 | 1.0 | 1.0 | 1.0 | 1.0 | 0.7 |
| 0.7 | 1.0 | 1.0 | 1.0 | 1.0 | 1.0 | 1.0 | 1.0 | 1.0 | 1.0 | 1.0 | 0.7 |
| 0.7 | 1.0 | 1.0 | 1.0 | 1.0 | 1.0 | 1.0 | 1.0 | 1.0 | 1.0 | 1.0 | 0.7 |
| 0.7 | 1.0 | 1.0 | 1.0 | 1.0 | 1.0 | 1.0 | 1.0 | 1.0 | 1.0 | 1.0 | 0.7 |
| 0.7 | 1.0 | 1.0 | 1.0 | 1.0 | 1.0 | 1.0 | 1.0 | 1.0 | 1.0 | 1.0 | 0.7 |
| 0.7 | 1.0 | 1.0 | 1.0 | 1.0 | 1.0 | 1.0 | 1.0 | 1.0 | 1.0 | 1.0 | 0.7 |
| 0.7 | 0.9 | 1.0 | 1.0 | 1.0 | 1.0 | 1.0 | 1.0 | 1.0 | 1.0 | 0.9 | 0.7 |
| 0.5 | 0.7 | 0.7 | 0.7 | 0.7 | 0.7 | 0.7 | 0.7 | 0.7 | 0.7 | 0.7 | 0.5 |

Fig.19A

| | | | | | | | | | | | |
|---|---|---|---|---|---|---|---|---|---|---|---|
| 0.0 | 0.0 | 0.0 | 0.0 | 0.0 | 0.0 | 0.0 | 0.0 | 0.0 | 0.0 | 0.0 | 0.0 |
| 0.0 | 1.0 | 1.0 | 1.0 | 1.0 | 1.0 | 1.0 | 1.0 | 1.0 | 1.0 | 1.0 | 0.0 |
| 0.0 | 1.0 | 1.0 | 1.0 | 1.0 | 1.0 | 1.0 | 1.0 | 1.0 | 1.0 | 1.0 | 0.0 |
| 0.0 | 1.0 | 1.0 | 1.0 | 1.0 | 1.0 | 1.0 | 1.0 | 1.0 | 1.0 | 1.0 | 0.0 |
| 0.0 | 1.0 | 1.0 | 1.0 | 1.0 | 1.0 | 1.0 | 1.0 | 1.0 | 1.0 | 1.0 | 0.0 |
| 0.0 | 1.0 | 1.0 | 1.0 | 1.0 | 1.0 | 1.0 | 1.0 | 1.0 | 1.0 | 1.0 | 0.0 |
| 0.0 | 1.0 | 1.0 | 1.0 | 1.0 | 1.0 | 1.0 | 1.0 | 1.0 | 1.0 | 1.0 | 0.0 |
| 0.0 | 1.0 | 1.0 | 1.0 | 1.0 | 1.0 | 1.0 | 1.0 | 1.0 | 1.0 | 1.0 | 0.0 |
| 0.0 | 1.0 | 1.0 | 1.0 | 1.0 | 1.0 | 1.0 | 1.0 | 1.0 | 1.0 | 1.0 | 0.0 |
| 0.0 | 1.0 | 1.0 | 1.0 | 1.0 | 1.0 | 1.0 | 1.0 | 1.0 | 1.0 | 1.0 | 0.0 |
| 0.0 | 1.0 | 1.0 | 1.0 | 1.0 | 1.0 | 1.0 | 1.0 | 1.0 | 1.0 | 1.0 | 0.0 |
| 0.0 | 0.0 | 0.0 | 0.0 | 0.0 | 0.0 | 0.0 | 0.0 | 0.0 | 0.0 | 0.0 | 0.0 |

Fig.19B

| | | | | | | | | | | | |
|---|---|---|---|---|---|---|---|---|---|---|---|
| 0.0 | 0.0 | 0.0 | 0.0 | 0.0 | 0.0 | 0.0 | 0.0 | 0.0 | 0.0 | 0.0 | 0.0 |
| 0.0 | 0.0 | 0.0 | 0.0 | 0.0 | 0.0 | 0.0 | 0.0 | 0.0 | 0.0 | 0.0 | 0.0 |
| 0.0 | 0.0 | 1.0 | 1.0 | 1.0 | 1.0 | 1.0 | 1.0 | 1.0 | 1.0 | 0.0 | 0.0 |
| 0.0 | 0.0 | 1.0 | 1.0 | 1.0 | 1.0 | 1.0 | 1.0 | 1.0 | 1.0 | 0.0 | 0.0 |
| 0.0 | 0.0 | 1.0 | 1.0 | 1.0 | 1.0 | 1.0 | 1.0 | 1.0 | 1.0 | 0.0 | 0.0 |
| 0.0 | 0.0 | 1.0 | 1.0 | 1.0 | 1.0 | 1.0 | 1.0 | 1.0 | 1.0 | 0.0 | 0.0 |
| 0.0 | 0.0 | 1.0 | 1.0 | 1.0 | 1.0 | 1.0 | 1.0 | 1.0 | 1.0 | 0.0 | 0.0 |
| 0.0 | 0.0 | 1.0 | 1.0 | 1.0 | 1.0 | 1.0 | 1.0 | 1.0 | 1.0 | 0.0 | 0.0 |
| 0.0 | 0.0 | 1.0 | 1.0 | 1.0 | 1.0 | 1.0 | 1.0 | 1.0 | 1.0 | 0.0 | 0.0 |
| 0.0 | 0.0 | 1.0 | 1.0 | 1.0 | 1.0 | 1.0 | 1.0 | 1.0 | 1.0 | 0.0 | 0.0 |
| 0.0 | 0.0 | 0.0 | 0.0 | 0.0 | 0.0 | 0.0 | 0.0 | 0.0 | 0.0 | 0.0 | 0.0 |
| 0.0 | 0.0 | 0.0 | 0.0 | 0.0 | 0.0 | 0.0 | 0.0 | 0.0 | 0.0 | 0.0 | 0.0 |

Fig.19C

| | | | | | | | | | | | |
|---|---|---|---|---|---|---|---|---|---|---|---|
| 0.0 | 0.0 | 0.0 | 0.0 | 0.0 | 0.0 | 0.0 | 0.0 | 0.0 | 0.0 | 0.0 | 0.0 |
| 0.0 | 0.0 | 0.0 | 0.0 | 0.0 | 0.0 | 0.0 | 0.0 | 0.0 | 0.0 | 0.0 | 0.0 |
| 0.0 | 0.0 | 0.0 | 0.0 | 0.0 | 0.0 | 0.0 | 0.0 | 0.0 | 0.0 | 0.0 | 0.0 |
| 0.0 | 0.0 | 0.0 | 0.5 | 0.7 | 0.7 | 0.7 | 0.7 | 0.5 | 0.0 | 0.0 | 0.0 |
| 0.0 | 0.0 | 0.0 | 0.7 | 0.9 | 1.0 | 1.0 | 0.9 | 0.7 | 0.0 | 0.0 | 0.0 |
| 0.0 | 0.0 | 0.0 | 0.7 | 1.0 | 1.0 | 1.0 | 1.0 | 0.7 | 0.0 | 0.0 | 0.0 |
| 0.0 | 0.0 | 0.0 | 0.7 | 1.0 | 1.0 | 1.0 | 1.0 | 0.7 | 0.0 | 0.0 | 0.0 |
| 0.0 | 0.0 | 0.0 | 0.7 | 0.9 | 1.0 | 1.0 | 0.9 | 0.7 | 0.0 | 0.0 | 0.0 |
| 0.0 | 0.0 | 0.0 | 0.5 | 0.7 | 0.7 | 0.7 | 0.7 | 0.5 | 0.0 | 0.0 | 0.0 |
| 0.0 | 0.0 | 0.0 | 0.0 | 0.0 | 0.0 | 0.0 | 0.0 | 0.0 | 0.0 | 0.0 | 0.0 |
| 0.0 | 0.0 | 0.0 | 0.0 | 0.0 | 0.0 | 0.0 | 0.0 | 0.0 | 0.0 | 0.0 | 0.0 |
| 0.0 | 0.0 | 0.0 | 0.0 | 0.0 | 0.0 | 0.0 | 0.0 | 0.0 | 0.0 | 0.0 | 0.0 |

Fig.21

205

| | | | | | | | | | | | |
|---|---|---|---|---|---|---|---|---|---|---|---|
| 2.0 | 1.4 | 1.4 | 1.4 | 1.4 | 1.4 | 1.4 | 1.4 | 1.4 | 1.4 | 1.4 | 2.0 |
| 1.4 | 1.1 | 1.0 | 1.0 | 1.0 | 1.0 | 1.0 | 1.0 | 1.0 | 1.0 | 1.1 | 1.4 |
| 1.4 | 1.0 | 1.0 | 1.0 | 1.0 | 1.0 | 1.0 | 1.0 | 1.0 | 1.0 | 1.0 | 1.4 |
| 1.4 | 1.0 | 1.0 | 1.0 | 1.0 | 1.0 | 1.0 | 1.0 | 1.0 | 1.0 | 1.0 | 1.4 |
| 1.4 | 1.0 | 1.0 | 1.0 | 1.0 | 1.0 | 1.0 | 1.0 | 1.0 | 1.0 | 1.0 | 1.4 |
| 1.4 | 1.0 | 1.0 | 1.0 | 1.0 | 1.0 | 1.0 | 1.0 | 1.0 | 1.0 | 1.0 | 1.4 |
| 1.4 | 1.0 | 1.0 | 1.0 | 1.0 | 1.0 | 1.0 | 1.0 | 1.0 | 1.0 | 1.0 | 1.4 |
| 1.4 | 1.0 | 1.0 | 1.0 | 1.0 | 1.0 | 1.0 | 1.0 | 1.0 | 1.0 | 1.0 | 1.4 |
| 1.4 | 1.0 | 1.0 | 1.0 | 1.0 | 1.0 | 1.0 | 1.0 | 1.0 | 1.0 | 1.0 | 1.4 |
| 1.4 | 1.0 | 1.0 | 1.0 | 1.0 | 1.0 | 1.0 | 1.0 | 1.0 | 1.0 | 1.0 | 1.4 |
| 1.4 | 1.1 | 1.0 | 1.0 | 1.0 | 1.0 | 1.0 | 1.0 | 1.0 | 1.0 | 1.1 | 1.4 |
| 2.0 | 1.4 | 1.4 | 1.4 | 1.4 | 1.4 | 1.4 | 1.4 | 1.4 | 1.4 | 1.4 | 2.0 |

Fig.22

206a

| | | | | | | | | | | | |
|---|---|---|---|---|---|---|---|---|---|---|---|
| 2.0 | 1.4 | 1.4 | 1.4 | 1.4 | 1.4 | 1.4 | 1.4 | 1.4 | 1.4 | 1.4 | 2.0 |
| 1.4 | 1.1 | 1.0 | 1.0 | 1.0 | 1.0 | 1.0 | 1.0 | 1.0 | 1.0 | 1.1 | 1.4 |
| 1.4 | 1.0 | 1.0 | 1.0 | 1.0 | 1.0 | 1.0 | 1.0 | 1.0 | 1.0 | 1.0 | 1.4 |
| 1.4 | 1.0 | 1.0 | 2.0 | 1.4 | 1.4 | 1.4 | 1.4 | 2.0 | 1.0 | 1.0 | 1.4 |
| 1.4 | 1.0 | 1.0 | 1.4 | 1.1 | 1.0 | 1.0 | 1.1 | 1.4 | 1.0 | 1.0 | 1.4 |
| 1.4 | 1.0 | 1.0 | 1.4 | 1.0 | 1.0 | 1.0 | 1.0 | 1.4 | 1.0 | 1.0 | 1.4 |
| 1.4 | 1.0 | 1.0 | 1.4 | 1.0 | 1.0 | 1.0 | 1.0 | 1.4 | 1.0 | 1.0 | 1.4 |
| 1.4 | 1.0 | 1.0 | 1.4 | 1.1 | 1.0 | 1.0 | 1.1 | 1.4 | 1.0 | 1.0 | 1.4 |
| 1.4 | 1.0 | 1.0 | 2.0 | 1.4 | 1.4 | 1.4 | 1.4 | 2.0 | 1.0 | 1.0 | 1.4 |
| 1.4 | 1.0 | 1.0 | 1.0 | 1.0 | 1.0 | 1.0 | 1.0 | 1.0 | 1.0 | 1.0 | 1.4 |
| 1.4 | 1.1 | 1.0 | 1.0 | 1.0 | 1.0 | 1.0 | 1.0 | 1.0 | 1.0 | 1.1 | 1.4 |
| 2.0 | 1.4 | 1.4 | 1.4 | 1.4 | 1.4 | 1.4 | 1.4 | 1.4 | 1.4 | 1.4 | 2.0 |

Fig.23

206b

| | | | | | | | | | | | |
|---|---|---|---|---|---|---|---|---|---|---|---|
| 2.0 | 1.4 | 1.4 | 1.4 | 1.4 | 1.4 | 1.4 | 1.4 | 1.4 | 1.4 | 1.4 | 2.0 |
| 1.4 | 1.1 | 1.0 | 1.0 | 1.0 | 1.0 | 1.0 | 1.0 | 1.0 | 1.0 | 1.1 | 1.4 |
| 1.4 | 1.0 | 1.0 | 1.0 | 1.0 | 1.0 | 1.0 | 1.0 | 1.0 | 1.0 | 1.0 | 1.4 |
| 1.4 | 1.0 | 1.0 | 1.0 | 1.0 | 1.0 | 1.0 | 1.0 | 1.0 | 1.0 | 1.0 | 1.4 |
| 1.4 | 1.0 | 1.0 | 1.0 | 1.1 | 1.0 | 1.0 | 1.1 | 1.0 | 1.0 | 1.0 | 1.4 |
| 1.4 | 1.0 | 1.0 | 1.0 | 1.0 | 1.0 | 1.0 | 1.0 | 1.0 | 1.0 | 1.0 | 1.4 |
| 2.0 | 1.4 | 1.4 | 1.4 | 1.4 | 2.0 | 1.0 | 1.0 | 1.0 | 1.0 | 1.0 | 1.4 |
| 1.4 | 1.1 | 1.0 | 1.0 | 1.1 | 1.4 | 1.0 | 1.1 | 1.0 | 1.0 | 1.0 | 1.4 |
| 1.4 | 1.0 | 1.0 | 1.0 | 1.0 | 1.4 | 1.0 | 1.0 | 1.0 | 1.0 | 1.0 | 1.4 |
| 1.4 | 1.0 | 1.0 | 1.0 | 1.0 | 1.4 | 1.0 | 1.0 | 1.0 | 1.0 | 1.0 | 1.4 |
| 1.4 | 1.1 | 1.0 | 1.0 | 1.1 | 1.4 | 1.0 | 1.0 | 1.0 | 1.0 | 1.1 | 1.4 |
| 2.0 | 1.4 | 1.4 | 1.4 | 1.4 | 2.0 | 1.4 | 1.4 | 1.4 | 1.4 | 1.4 | 2.0 |

Fig.28

44

| | | | | | | | | | | | |
|---|---|---|---|---|---|---|---|---|---|---|---|
| 0.0 | 0.0 | 0.0 | 0.0 | 0.0 | 0.0 | 0.0 | 0.0 | 0.0 | 0.0 | 0.0 | 0.0 |
| 0.0 | 0.0 | 0.0 | 0.0 | 0.0 | 0.0 | 0.0 | 0.0 | 0.0 | 0.0 | 0.0 | 0.0 |
| 0.0 | 0.0 | 0.0 | 0.0 | 0.0 | 0.0 | 0.0 | 0.0 | 0.0 | 0.0 | 0.0 | 0.0 |
| 0.0 | 0.0 | 0.0 | 1.0 | 1.0 | 1.0 | 1.0 | 1.0 | 1.0 | 0.0 | 0.0 | 0.0 |
| 0.0 | 0.0 | 0.0 | 1.0 | 1.0 | 1.0 | 1.0 | 1.0 | 1.0 | 0.0 | 0.0 | 0.0 |
| 0.0 | 0.0 | 0.0 | 1.0 | 1.0 | 1.0 | 1.0 | 1.0 | 1.0 | 0.0 | 0.0 | 0.0 |
| 0.0 | 0.0 | 0.0 | 1.0 | 1.0 | 1.0 | 1.0 | 1.0 | 1.0 | 0.0 | 0.0 | 0.0 |
| 0.0 | 0.0 | 0.0 | 1.0 | 1.0 | 1.0 | 1.0 | 1.0 | 1.0 | 0.0 | 0.0 | 0.0 |
| 0.0 | 0.0 | 0.0 | 1.0 | 1.0 | 1.0 | 1.0 | 1.0 | 1.0 | 0.0 | 0.0 | 0.0 |
| 0.0 | 0.0 | 0.0 | 0.0 | 0.0 | 0.0 | 0.0 | 0.0 | 0.0 | 0.0 | 0.0 | 0.0 |
| 0.0 | 0.0 | 0.0 | 0.0 | 0.0 | 0.0 | 0.0 | 0.0 | 0.0 | 0.0 | 0.0 | 0.0 |
| 0.0 | 0.0 | 0.0 | 0.0 | 0.0 | 0.0 | 0.0 | 0.0 | 0.0 | 0.0 | 0.0 | 0.0 |

Fig.29

44

| | | | | | | | | | | | |
|---|---|---|---|---|---|---|---|---|---|---|---|
| 0.0 | 0.0 | 0.0 | 0.0 | 0.0 | 0.0 | 0.0 | 0.0 | 0.0 | 0.0 | 0.0 | 0.0 |
| 0.0 | 0.0 | 0.0 | 0.0 | 0.0 | 0.0 | 0.0 | 0.0 | 0.0 | 0.0 | 0.0 | 0.0 |
| 0.0 | 0.0 | 0.0 | 0.0 | 0.0 | 0.0 | 0.0 | 0.0 | 0.0 | 0.0 | 0.0 | 0.0 |
| 0.0 | 0.0 | 0.0 | 1.0 | 0.7 | 0.7 | 0.7 | 0.7 | 1.0 | 0.0 | 0.0 | 0.0 |
| 0.0 | 0.0 | 0.0 | 0.7 | 0.9 | 0.5 | 0.5 | 0.9 | 0.7 | 0.0 | 0.0 | 0.0 |
| 0.0 | 0.0 | 0.0 | 0.7 | 0.5 | 0.5 | 0.5 | 0.5 | 0.7 | 0.0 | 0.0 | 0.0 |
| 0.0 | 0.0 | 0.0 | 0.7 | 0.5 | 0.5 | 0.5 | 0.5 | 0.7 | 0.0 | 0.0 | 0.0 |
| 0.0 | 0.0 | 0.0 | 0.7 | 0.9 | 0.5 | 0.5 | 0.9 | 0.7 | 0.0 | 0.0 | 0.0 |
| 0.0 | 0.0 | 0.0 | 1.0 | 0.7 | 0.7 | 0.7 | 0.7 | 1.0 | 0.0 | 0.0 | 0.0 |
| 0.0 | 0.0 | 0.0 | 0.0 | 0.0 | 0.0 | 0.0 | 0.0 | 0.0 | 0.0 | 0.0 | 0.0 |
| 0.0 | 0.0 | 0.0 | 0.0 | 0.0 | 0.0 | 0.0 | 0.0 | 0.0 | 0.0 | 0.0 | 0.0 |
| 0.0 | 0.0 | 0.0 | 0.0 | 0.0 | 0.0 | 0.0 | 0.0 | 0.0 | 0.0 | 0.0 | 0.0 |

Fig.30

306

| | | | | | | | | | | | |
|---|---|---|---|---|---|---|---|---|---|---|---|
| 0.0 | 0.0 | 0.0 | 0.0 | 0.0 | 0.0 | 0.0 | 0.0 | 0.0 | 0.0 | 0.0 | 0.0 |
| 0.0 | 0.0 | 0.0 | 0.0 | 0.0 | 0.0 | 0.0 | 0.0 | 0.0 | 0.0 | 0.0 | 0.0 |
| 0.0 | 0.0 | 0.0 | 0.0 | 0.0 | 0.0 | 0.0 | 0.0 | 0.0 | 0.0 | 0.0 | 0.0 |
| 0.0 | 0.0 | 0.0 | 2.0 | 2.0 | 2.0 | 2.0 | 2.0 | 2.0 | 0.0 | 0.0 | 0.0 |
| 0.0 | 0.0 | 0.0 | 2.0 | 2.0 | 2.0 | 2.0 | 2.0 | 2.0 | 0.0 | 0.0 | 0.0 |
| 0.0 | 0.0 | 0.0 | 2.0 | 2.0 | 2.0 | 2.0 | 2.0 | 2.0 | 0.0 | 0.0 | 0.0 |
| 0.0 | 0.0 | 0.0 | 2.0 | 2.0 | 2.0 | 2.0 | 2.0 | 2.0 | 0.0 | 0.0 | 0.0 |
| 0.0 | 0.0 | 0.0 | 2.0 | 2.0 | 2.0 | 2.0 | 2.0 | 2.0 | 0.0 | 0.0 | 0.0 |
| 0.0 | 0.0 | 0.0 | 2.0 | 2.0 | 2.0 | 2.0 | 2.0 | 2.0 | 0.0 | 0.0 | 0.0 |
| 0.0 | 0.0 | 0.0 | 0.0 | 0.0 | 0.0 | 0.0 | 0.0 | 0.0 | 0.0 | 0.0 | 0.0 |
| 0.0 | 0.0 | 0.0 | 0.0 | 0.0 | 0.0 | 0.0 | 0.0 | 0.0 | 0.0 | 0.0 | 0.0 |
| 0.0 | 0.0 | 0.0 | 0.0 | 0.0 | 0.0 | 0.0 | 0.0 | 0.0 | 0.0 | 0.0 | 0.0 |

Fig.32

45

| | | | | | |
|---|---|---|---|---|---|
| 1.0 | 1.0 | 1.0 | 1.0 | 1.0 | 1.0 |
| 1.0 | 1.0 | 1.0 | 1.0 | 1.0 | 1.0 |
| 1.0 | 1.0 | 1.0 | 1.0 | 1.0 | 1.0 |
| 1.0 | 1.0 | 1.0 | 1.0 | 1.0 | 1.0 |
| 1.0 | 1.0 | 1.0 | 1.0 | 1.0 | 1.0 |
| 1.0 | 1.0 | 1.0 | 1.0 | 1.0 | 1.0 |

Fig.33

406

| | | | | | |
|---|---|---|---|---|---|
| 0.5 | 0.7 | 0.7 | 0.7 | 0.7 | 0.5 |
| 0.7 | 0.9 | 1.0 | 1.0 | 0.9 | 0.7 |
| 0.7 | 1.0 | 1.0 | 1.0 | 1.0 | 0.7 |
| 0.7 | 1.0 | 1.0 | 1.0 | 1.0 | 0.7 |
| 0.7 | 0.9 | 1.0 | 1.0 | 0.9 | 0.7 |
| 0.5 | 0.7 | 0.7 | 0.7 | 0.7 | 0.5 |

IMAGE DISPLAY DEVICE AND IMAGE DISPLAY METHOD

TECHNICAL FIELD

The present invention relates to image display devices, particularly to an image display device having a function of controlling the luminance of a backlight (backlight dimming function).

BACKGROUND ART

In image display devices provided with backlights such as liquid crystal display devices, by controlling the luminances of the backlights on the basis of input images, the power consumption of the backlights can be suppressed and the image quality of a displayed image can be improved. In particular, by dividing a screen into a plurality of areas and controlling the luminances of backlight sources corresponding to the areas on the basis of portions of an input image within the areas, it is rendered possible to achieve lower power consumption and higher image quality. Hereinafter, such a method for driving a display panel while controlling the luminances of backlight sources on the basis of an input image in each area will be referred to as "area-active drive".

Liquid crystal display devices that perform area-active drive use, for example, LEDs (light emitting diodes) of three RGB colors or white LEDs, as backlight sources. Luminances (Luminances upon emission) of LEDs corresponding to areas are obtained on the basis of, for example, maximum or mean values of pixel luminances within the areas, and are provided to a backlight driver circuit as LED data. In addition, display data (in the case of liquid crystal display devices, data for controlling the light transmittance of the liquid crystal) is generated on the basis of the LED data and an input image, and the display data is provided to a driver circuit for a display panel. In the case of liquid crystal display devices, the luminance of each pixel on the screen is the product of the luminance of light from the backlight and the light transmittance based on the display data.

By the way, light emitted from LEDs in an area illuminates not only that area but also its surrounding areas. In other words, an area is illuminated not only by light emitted from LEDs in that area but also light emitted from LEDs in its surrounding areas. Accordingly, luminances achieved for display in areas by all LEDs emitting light have to be calculated considering diffusion (spread) of light emitted from each LED. Therefore, when generating the aforementioned display data, for example, a luminance spread filter 104 as shown in FIG. 5 is conventionally used. The luminance spread filter 104 has stored therein numerical data, which indicates how light emitted from LEDs in areas is diffused. In addition, the luminance spread filter is used to calculate luminances (hereinafter, referred to as "display luminances") that can be achieved upon display (or estimated to be achieved upon display) in areas by all LEDs emitting light, and display data is generated on the basis of the display luminances and an input image.

By driving a driver circuit for a display panel on the basis of the display data thus generated and a driver circuit for a backlight on the basis of the aforementioned LED data, image display based on an input image can be performed.

Note that the following conventional technology documents are known in the art relevant to the present invention. Japanese Laid-Open Patent Publication Nos. 2004-184937, 2005-258403, and 2007-34251 disclose inventions of display devices in which the screen is divided into a plurality of areas and the emission luminance of a backlight provided for each area is controlled to reduce power consumption. In particular, the liquid crystal display device disclosed in Japanese Laid-Open Patent Publication No. 2004-184937 achieves reduced power consumption by automatically turning off backlight sources for a non-display region.

PRIOR ART DOCUMENTS

Patent Documents

Patent Document 1: Japanese Laid-Open Patent Publication No. 2004-184937

Patent Document 2: Japanese Laid-Open Patent Publication No. 2005-258403

Patent Document 3: Japanese Laid-Open Patent Publication No. 2007-34251

SUMMARY OF THE INVENTION

Problems to be Solved by the Invention

However, in the case of conventional image display devices which perform area-active drive, when performing a partial display (e.g., when a high-resolution display device called "4K2K" displays full HD standard images), LEDs are lit up in a considerably wider range than a display area. The reason for this is to prevent insufficient luminances at the edge of the display area. In this manner, in the case of conventional image display devices, even LEDs corresponding to a non-display area are lit up, resulting in unnecessary power consumption. In addition, if the LEDs corresponding to the non-display area are turned off, some display failure might occur, including no tone display being correctly provided.

Therefore, an objective of the present invention is to achieve low power consumption without causing any display failure in performing partial display, in an image display device which performs area-active drive.

MEANS FOR SOLVING THE PROBLEMS

A first aspect of the present invention is directed to an image display device provided with a display panel including a plurality of display elements, the device having a full display function for displaying an image based on an externally provided input image on the entire display panel and a partial display function for displaying an image based on the input image in a partial region of the display panel, the device comprising:

a backlight including a plurality of light sources;

an emission luminance calculation section for dividing the input image into the same number of areas as the light sources and obtaining an emission luminance which is a luminance upon emission of the light source corresponding to each area;

a display luminance calculation section for calculating a display luminance for each area on the basis of the emission luminance of the light source corresponding to that area and emission luminances of light sources corresponding to predetermined areas surrounding that area, the display luminance being a luminance achievable upon display in that area;

a display position information acquisition section for acquiring display position identification data to identify a display region in which the image based on the input image should be displayed when performing partial display;

a correction filter having correction values stored therein in association with the areas or the display elements, the correction values being values determined in accordance with the display region identified by the display position identification data;

a display data calculation section for calculating display data for controlling a light transmittance of each display element, on the basis of the input image, the display luminance, and the correction values stored in the correction filter;

a panel driver circuit for outputting a light transmittance control signal for controlling the light transmittance of each display element to the display panel, on the basis of the display data; and a backlight driver circuit for outputting a luminance control signal for controlling the luminance of each light source to the backlight, on the basis of the emission luminance.

According to a second aspect of the present invention, in the first aspect of the present invention, the image display device further comprises a correction filter selection section for selecting a correction filter to be referenced by the display data calculation section from among a full display filter and one or more partial display filters, which are prepared as the correction filters, on the basis of the display position identification data.

According to a third aspect of the present invention, in the first aspect of the present invention, the image display device further comprises a correction filter generation section for generating the correction filter, wherein, when there is a change in the display region identified by the display position identification data, the emission luminance calculation section calculates the emission luminance of the light source corresponding to each area, such that emission luminances of light sources corresponding to the display region after the change are set to a maximum possible luminance value for the light sources, and emission luminances of light sources corresponding to a non-display region after the change are set to a minimum possible luminance value for the light sources, and the correction filter generation section generates the correction filter by setting the display luminance calculated by the display luminance calculation section as the correction value without modification.

According to a fourth aspect of the present invention, in the third aspect of the present invention, when there is a change in the display region identified by the display position identification data, the back light driver circuit outputs the luminance control signal such that all of the light sources are turned off.

According to a fifth aspect of the present invention, in the first aspect of the present invention, when the display luminance corresponding to an arbitrary display element is 0, the display data calculation section sets the value of the display data for the display element to 0 and when the display luminance corresponding to the display element is not 0, the display data calculation section calculates the value of the display data for the display element by dividing a product of a pixel value of the input image and the correction value by the display luminance or by dividing the pixel value of the input image by a product of the display luminance and the correction value.

According to a sixth aspect of the present invention, in the first aspect of the present invention, the image display device further comprises a drive control section for providing the input image to the emission luminance calculation section at different times in accordance with the display region identified by the display position identification data, such that the panel driver circuit and the backlight driver circuit operate in accordance with the display region.

According to a seventh aspect of the present invention, in the sixth aspect of the present invention, when the input image has a lower resolution than the display panel in performing partial display, the drive control section provides the input image to the emission luminance calculation section with the timing for full display.

According to an eighth aspect of the present invention, in the first aspect of the present invention, in performing partial display, a frame image is displayed in a non-display region, the frame image being a prepared image.

According to a ninth aspect of the present invention, in the first aspect of the present invention, when there is a change in the display region identified by the display position identification data, the display data calculation section sequentially refers to three or more correction filters over time between before and after the change, such that an image displayed on the display panel gradually changes, the filters having stored therein their respective different patterns of correction values.

A tenth aspect of the present invention is directed to an image display method in an image display device provided with a display panel including a plurality of display elements and a backlight including a plurality of light sources , the device having a full display function for displaying an image based on an externally provided input image on the entire display panel and a partial display function for displaying an image based on the input image in a partial region of the display panel, the method comprising:

an emission luminance calculation step for dividing the input image into the same number of areas as the light sources and obtaining an emission luminance which is a luminance upon emission of the light source corresponding to each area;

a display luminance calculation step for calculating a display luminance for each area on the basis of the emission luminance of the light source corresponding to that area and emission luminances of light sources corresponding to predetermined areas surrounding that area, the display luminance being a luminance achievable upon display in that area;

a display position information acquisition step for acquiring display position identification data to identify a display region in which the image based on the input image should be displayed when performing partial display;

a display data calculation step for calculating display data for controlling a light transmittance of each display element, on the basis of correction values, the input image, and the display luminance, the correction values being values determined in accordance with the display region identified by the display position identification data and being stored in a predetermined correction filter in association with the areas or the display elements;

a panel drive step for outputting a light transmittance control signal for controlling the light transmittance of each display element to the display panel, on the basis of the display data; and a backlight drive step for outputting a luminance control signal for controlling the luminance of each light source to the backlight, on the basis of the emission luminance.

In addition, variants that are grasped by referring to the embodiment and the drawings in the tenth aspect of the present invention are considered to be means for solving the problems.

EFFECTS OF THE INVENTION

According to the first aspect of the present invention, the correction filter is generated on the basis of the display position identification data for identifying the display area. Then, the display data for controlling the light transmittances of the display elements is calculated on the basis of the input image, the display luminances, and the correction values stored in the correction filter. Thus, by generating the correction filter such that light sources emit light only within the range approximately equal to the display area when performing partial display, it is rendered possible to reduce power consumption when performing partial display. In addition, the display data is calculated by dividing the pixel values of the input image by the display luminances, and the correction values stored in the correction filter can be used to reduce the pixel values of the input image or increase the display luminances. As a result, even in regions with relatively low display luminances, such as portions close to the edges of the display area, overflow is inhibited from occurring when dividing the pixel values of the input image by the display luminances. Thus, low power consumption can be achieved without causing any display failure in performing partial display.

According to the second aspect of the present invention, the correction filter to be referenced by the display data calculation section is selected from among prepared filters. Thus, it is not necessary to generate any correction filter while the image display device is in operation.

According to the third aspect of the present invention, a correction filter suitable for partial display is automatically generated. Thus, it is not necessary to prepare any correction filter and hold numerical data to be stored in the correction filter in advance.

According to the fourth aspect of the present invention, when a correction filter is automatically generated, all light sources are turned off. Thus, it is possible to prevent the screen from being lit up momentarily in white when the display area changes.

According to the fifth aspect of the present invention, for each pixel, when its display luminance is 0, the value of display data for that pixel is set to 0 without being affected by values of other data. Thus, it is possible to prevent a so-called "division by zero" from occurring when calculating the display data. Thus, it is possible to prevent the display device from operating abnormally due to display luminances of pixels in the non-display area being 0.

According to the sixth aspect of the present invention, for example, components for driving the non-display area can be stooped from operating, and therefore, it is possible to remarkably reduce power consumption.

According to the seventh aspect of the present invention, even in the case where an input image with a different resolution from the display panel is externally provided, it is possible to display an image based on the input image in a desired position on the display panel.

According to the eighth aspect of the present invention, it is possible to display a desired image in the non-display area when performing partial display.

According to the ninth aspect of the present invention, when there is any change in the display area, such as switching between full display and partial display, the correction filter to be referenced by the display data calculation section gradually changes. Thus, the display image is inhibited from abruptly changing when there is any change in the display area, so that the display area changes without causing the display to be unnatural to the human eye.

BRIEF DESCRIPTION OF THE DRAWINGS

FIG. 5 is a diagram illustrating a luminance spread filter.

FIG. 8 is a diagram illustrating an exemplary partial display correction filter in the first embodiment.

FIG. 9 is a diagram illustrating another exemplary partial display correction filter in the first embodiment.

FIG. 12 is a diagram illustrating an exemplary partial display correction filter when performing full display in the first embodiment.

FIG. 13 is a diagram illustrating another exemplary partial display correction filter when performing full display in the first embodiment.

FIGS. 19A to 19C are diagrams describing a change in a partial display correction filter in a variant of the first embodiment.

FIG. 21 is a diagram illustrating an exemplary display luminance correction filter in the second embodiment.

FIG. 22 is a diagram illustrating an exemplary partial display correction filter in the second embodiment.

FIG. 23 is a diagram illustrating another exemplary partial display correction filter in the second embodiment.

FIG. 28 is a diagram illustrating an exemplary masking filter in the third embodiment.

FIG. 29 is a diagram illustrating another exemplary masking filter in the third embodiment.

FIG. 30 is a diagram illustrating an exemplary partial display correction filter in the third embodiment.

FIG. 32 is a diagram illustrating an exemplary filter to be provided to an LED output value calculation section in the fourth embodiment.

FIG. 33 is a diagram illustrating an exemplary partial display correction filter in the fourth embodiment.

MODE FOR CARRYING OUT THE INVENTION

Hereinafter, embodiments of the present invention will be described with reference to the accompanying drawings.

<1. First Embodiment>

<1.1 Overall Configuration and Overview of the Operation>

Figure 2:
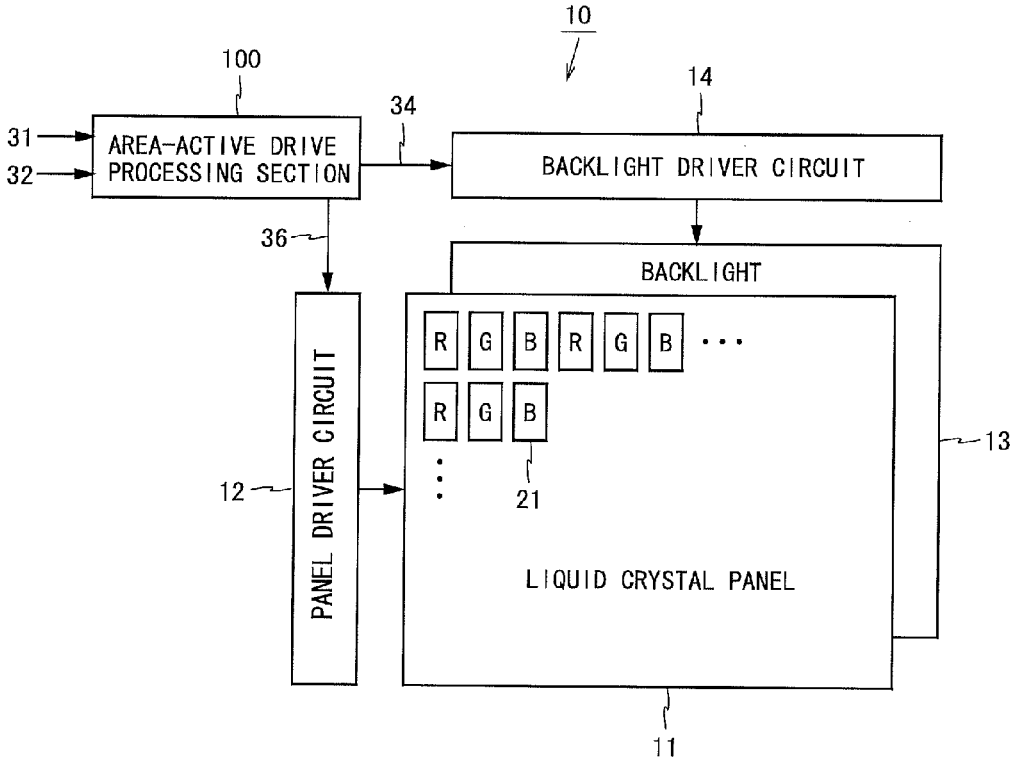
FIG. 2 is a block diagram illustrating the configuration of a liquid crystal display device according to the first embodiment.

FIG. 2 is a block diagram illustrating the configuration of a liquid crystal display device 10 according to a first embodiment of the present invention. The liquid crystal display device 10 shown in FIG. 2 includes a liquid crystal panel 11, a panel driver circuit 12, a backlight 13, a backlight driver circuit 14, and an area-active drive processing section 100. The liquid crystal display device 10 performs area-active drive in which the liquid crystal panel 11 is driven with luminances of backlight sources being controlled on the basis of input image portions within a plurality of areas defined by dividing the screen. In the following, m and n are integers of 2 or more, p and q are integers of 1 or more, but at least one of p and q is an integer of 2 or more.

The liquid crystal display device 10 receives an input image 31, including an R image, a G image, and a B image, and display position information 32 for identifying an image display position (a display range) on the screen of the liquid crystal panel 11. Each of the R, G, and B images includes luminances for (m×n) pixels. On the basis of the input image 31 and the display position information 32, the area-active drive processing section 100 obtains display data (hereinafter, referred to as "liquid crystal data 36") for use in driving the liquid crystal panel 11 and backlight control data (hereinafter, referred to as "LED data 34") for use in driving the backlight 13 (details will be described later)

The liquid crystal panel 11 includes (m×n×3) display elements 21. The display elements 21 are arranged two-dimensionally as a whole, with each row including 3m of them in its direction (in FIG. 2, horizontally) and each column including n of them in its direction (in FIG. 2, vertically). The display elements 21 include R, G, and B display elements respectively transmitting red, green, and blue light therethrough. The R display elements, the G display elements, and the B display elements are arranged side by side in the row direction, and three display elements form a single pixel.

The panel driver circuit 12 is a circuit for driving the liquid crystal panel 11. On the basis of liquid crystal data 36 outputted by the area-active drive processing section 100, the panel driver circuit 12 outputs signals (voltage signals) for controlling light transmittances of the display elements 21 to the liquid crystal panel 11. The voltages outputted by the panel driver circuit 12 are written to pixel electrodes (not shown) in the display elements 21, and the light transmittances of the display elements 21 change in accordance with the voltages written to the pixel electrodes.

Figure 3:
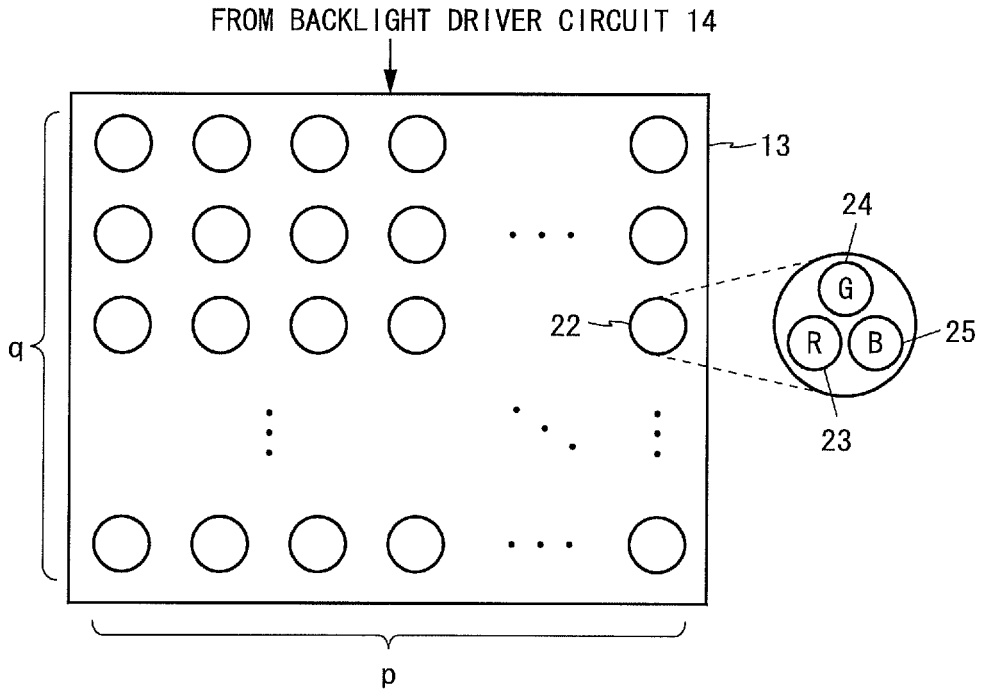
FIG. 3 is a diagram illustrating details of a back light shown in FIG. 2.

The backlight 13 is provided at the back side of the liquid crystal panel 11 to irradiate backlight light to the back of the liquid crystal panel 11. FIG. 3 is a diagram illustrating details of the backlight 13. The backlight 13 includes (p×q) LED units 22, as shown in FIG. 3. The LED units 22 are arranged two-dimensionally as a whole, with each row including p of them in its direction and each column including q of them in its direction. Each of the LED units 22 includes one red LED 23, one green LED 24, and one blue LED 25. Lights emitted from the three LEDs 23 to 25 included in one LED unit 22 hit a part of the back of the liquid crystal panel 11.

The backlight driver circuit 14 is a circuit for driving the backlight 13. On the basis of LED data 34 outputted by the area-active drive processing section 100, the backlight driver circuit 14 outputs signals (voltage signals or current signals) for controlling luminances of the LEDs 23 to 25 to the backlight 13. The luminances of the LEDs 23 to 25 are controlled independently of luminances of LEDs inside and outside their units.

The screen of the liquid crystal display device 10 is divided into (p×q) areas, each area corresponding to one LED unit 22. For each of the (p×q) areas, the area-active drive processing section 100 obtains the luminance of the red LEDs 23 that correspond to that area on the basis of an R. image within the area. Similarly, the luminance of the green LEDs 24 is determined on the basis of a G image within the area, and the luminance of the blue LEDs 25 is determined on the basis of a B image within that area. The area-active drive processing section 100 obtains luminances for all LEDs 23 to 25 included in the backlight 13, and outputs LED data 34 representing the obtained LED luminances to the backlight driver circuit 14.

Furthermore, on the basis of the LED data 34, the area-active drive processing section 100 obtains luminances of backlight lights for all display elements 21 included in the liquid crystal panel 11. In addition, on the basis of an input image 31 and the luminances of backlight lights, the area-active drive processing section 100 obtains light transmittances of all of the display elements 21 included in the liquid crystal panel 11, and outputs liquid crystal data 36 representing the obtained light transmittances to the panel driver circuit 12. Note that how the area-active drive processing section 100 obtains the luminances of backlight lights and the liquid crystal data 36 representing light transmittances will be described in detail later.

In the liquid crystal display device 10, the luminance of each R display element is the product of the luminance of red light emitted by the backlight 13 and the light transmittance of that R display element. Light emitted by one red LED 23 hits a plurality of areas around one corresponding area. Accordingly, the luminance of each R display element is the product of the total luminance of light emitted by a plurality of red LEDs 23 and the light transmittance of that R display element. Similarly, the luminance of each G display element is the product of the total luminance of light emitted by a plurality of green LEDs 24 and the light transmittance of that G display element, and the luminance of each B display element is the product of the total luminance of light emitted by a plurality of blue LEDs 25 and the light transmittance of that B display element.

According to the liquid crystal display device 10 thus configured, suitable liquid crystal data 36 and LED data 34 are obtained on the basis of the input image 31, the light transmittances of the display elements 21 are controlled on the basis of the liquid crystal data 36, and the luminances of the LEDs 23 to 25 are controlled on the basis of the LED data 34, so that the input image 31 can be displayed on the liquid crystal panel 11. In addition, when luminances of pixels within an area are low, luminances of LEDs 23 to 25 corresponding to that area are kept low, thereby reducing power consumption of the backlight 13. Moreover, when luminances of pixels within an area are low, luminances of display elements 21 corresponding to that area are switched among a smaller number of levels, making it possible to enhance image resolution and thereby to improve display image quality.

Figure 4:
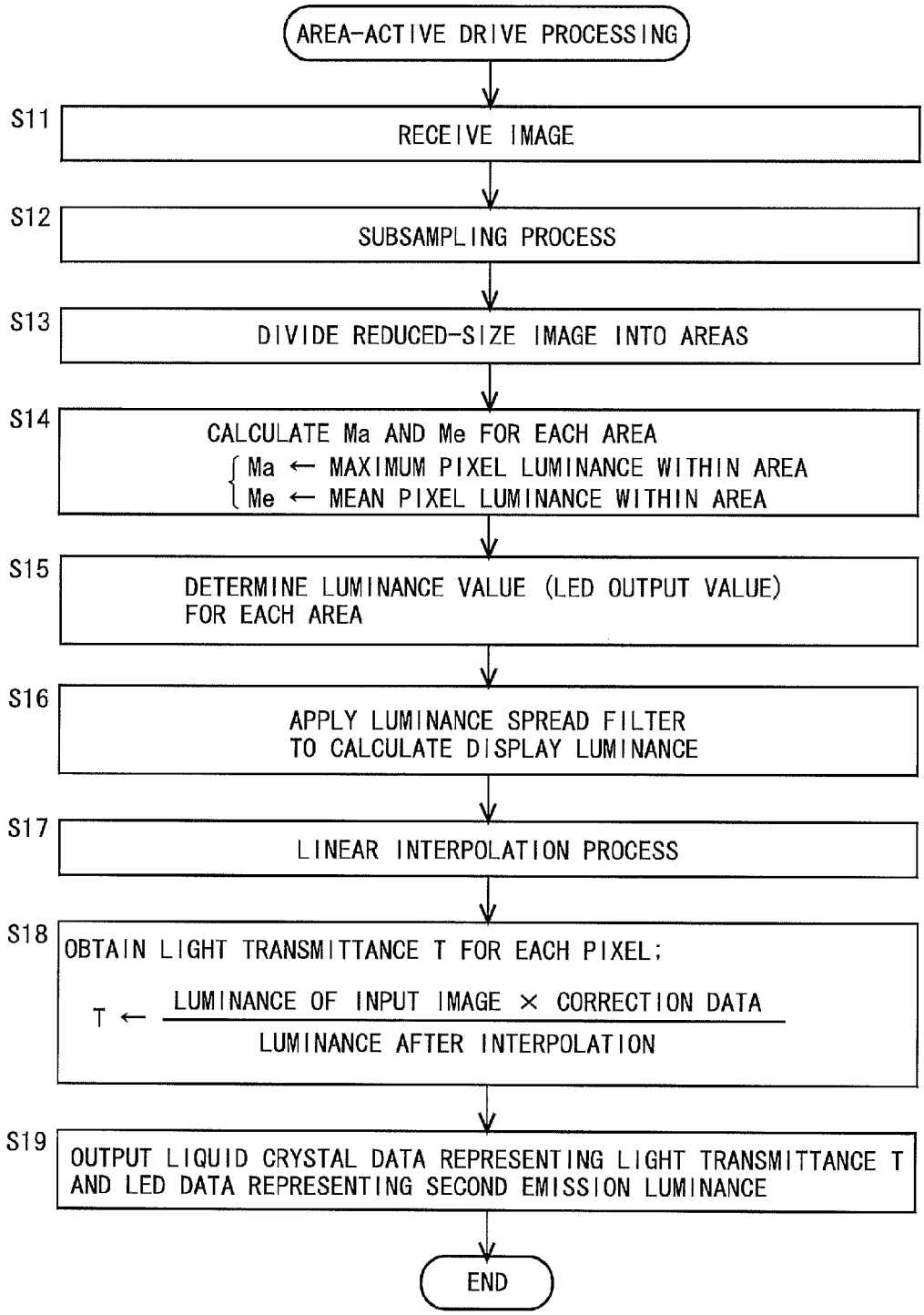
FIG. 4 is a flowchart showing a process by the area-active drive processing section in the first embodiment.

FIG. 4 is a flowchart showing a process by the area-active drive processing section 100. The area-active drive processing section 100 receives an image for a color component (hereinafter, referred to as color component C) included in the input image 31 (step S11). The input image for color component C includes luminances for (m×n) pixels.

Next, the area-active drive processing section 100 performs a subsampling process (averaging process) on the input image for color component C, and obtains a reduced-size image including luminances for (sp×sq) (where s is an integer of 2 or more) pixels (step S12). In step S12, the input image for color component C is reduced to sp/m in the horizontal direction and sq/n in the vertical direction. Then, the area-active drive processing section 100 divides the reduced-size image into (p×q) areas (step S13). Each area includes luminances for (s×s) pixels. Next, for each of the (p×q) areas, the area-active drive processing section 100 obtains a maximum value Ma of pixel luminances within that area and a mean value Me of pixel luminances within that area (step S14).

Next, the area-active drive processing section 100 obtains LED output values (values of luminances upon emission of LEDs) for each of the (p×q) areas (step S15). Examples of the method for determining the LED output values include a method that makes a determination on the basis of a maximum value Ma of pixel luminances within each area, a method that makes a determination on the basis of a mean value Me of pixel luminances within each area, and a method that makes a determination on the basis of a value obtained by calculating a weighted mean of the maximum value Ma and the mean value Me of pixel luminances within each area.

Next, the area-active drive processing section 100 applies a luminance spread filter (point spread filter) 104 to the (p×q) LED output values obtained in step S15, thereby obtaining first backlight luminance data including (tp×tq) (where t is an integer of 2 or more) display luminances (step S16). Note that the luminance spread filter 104 has stored therein PSF data (point spread filter data) , which is data representing the spread of light as numerical values, to calculate display luminance for each area, for example, as shown in FIG. 5. In step S16, the (p×q) LED output values are scaled up by a factor of t in both in the horizontal and the vertical direction, thereby obtaining (tp×tq) display luminances.

Next, the area-active drive processing section 100 performs a linear interpolation process on the first backlight luminance data, thereby obtaining second backlight luminance data including (m×n) display luminances (step S17). In step S17, the first backlight luminance data is scaled up by a factor of (m/tp) in the horizontal direction and a factor of (n/tq) in the vertical direction. The second backlight luminance data represents luminances of backlight lights for color component C that enter (m×n) display elements 21 for color component C when (p×q) LEDs for color component C emit lights at the luminances obtained in step S15.

Next, the area-active drive processing section 100 divides the products of the luminances (pixel values) of the (m×n) pixels included in the input image for color component C and the values of correction data (that correspond to the pixels) stored in a partial display correction filter to be described later respectively by the (m×n) luminances included in the second backlight luminance data, thereby obtaining light transmittances T of the (m×n) display elements 21 for color component C (step S18). Note that this process will be described in detail later.

Finally, for color component C, the area-active drive processing section 100 outputs liquid crystal data 36 representing the (m×n) light transmittances T obtained in step S18, and LED data 34 representing the (p×q) LED output values obtained in step S15 (step 519). At this time, the liquid crystal data 36 and the LED data 34 are converted to values within appropriate ranges in conformity with the specifications of the panel driver circuit 12 and the backlight driver circuit 14.

In this manner, the area-active drive processing section 100 performs the process shown in FIG. 4 on an R image, a G image, and a B image, thereby obtaining liquid crystal data 36 representing (m×n×3) light transmittances and LED data 34 representing (p×q×3) LED output values, on the basis of an input image 31 including luminances of (m×n×3) pixels.

Figure 6:
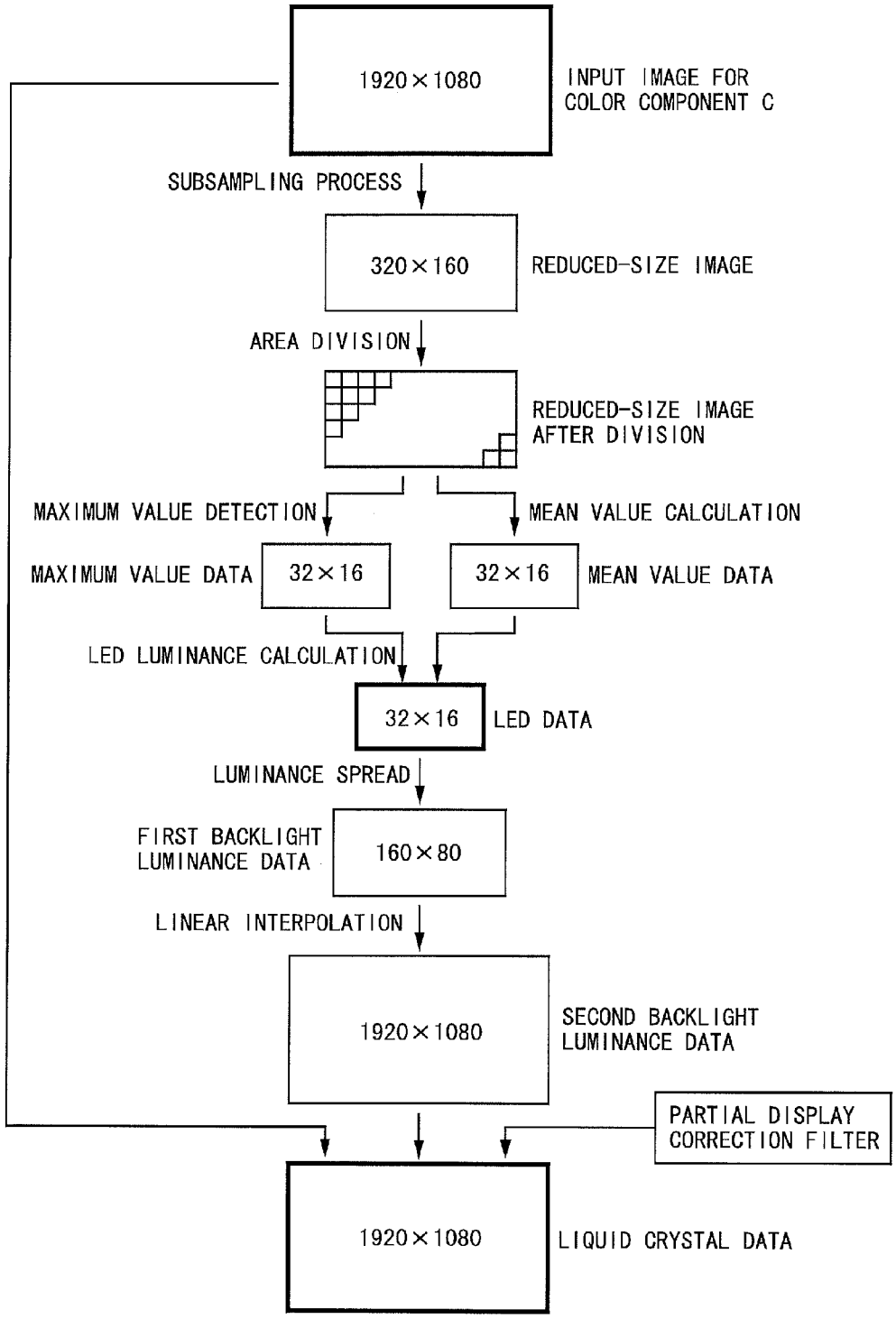
FIG. 6 is a diagram showing the course of action up to obtaining liquid crystal data and LED data in the first embodiment.

FIG. 6 is a diagram showing the course of action up to obtaining liquid crystal data 36 and LED data 34 where in m=1920, n=1080, p=32, q=16, s=10, and t=5. As shown in FIG. 6, a subsampling process is performed on an input image for color component C, which includes luminances of (1920×1080) pixels, thereby obtaining a reduced-size image including luminances of (320×160) pixels. The reduced-size image is divided into (32×16) areas (the size of each area is (10×10) pixels). By calculating the maximum value Ma and the mean value Me of the pixel luminances for each area, maximum value data including (32×16) maximum values and mean value data including (32×16) mean values are obtained. Then, on the basis of the maximum value data, the mean value data, or weighted averaging of the maximum value data and the mean value data, LED data 34 for the color component C, which represents (32×16) LED luminances (LED output values), is obtained.

By applying the luminance spread filter 104 to the LED data 34 for color component C, first backlight luminance data including (160×80) luminances is obtained. By performing a linear interpolation process on the first backlight luminance data, second backlight luminance data including (1920×1080) luminances is obtained. Finally, by dividing the products of the pixel luminances included in the input image and the values of correction data stored in the partial display correction filter by the display luminances included in the second backlight luminance data, liquid crystal data 36 for color component C, which includes (1920×1080) light transmittances, is obtained.

Note that in FIGS. 4 and 6, for ease of explanation, the area-active drive processing section 100 sequentially performs the process on images for color components, but the process may be performed on the images for color components in a time-division manner. Furthermore, in FIGS. 4 and 6, the area-active drive processing section 100 performs a subsampling process on an input image for noise removal and performs area-active drive on the basis of a reduced-size image, but the area active drive may be performed on the basis of the original input image.

<1.2 Configuration of the Area-Active Drive Processing Section>

Figure 1:
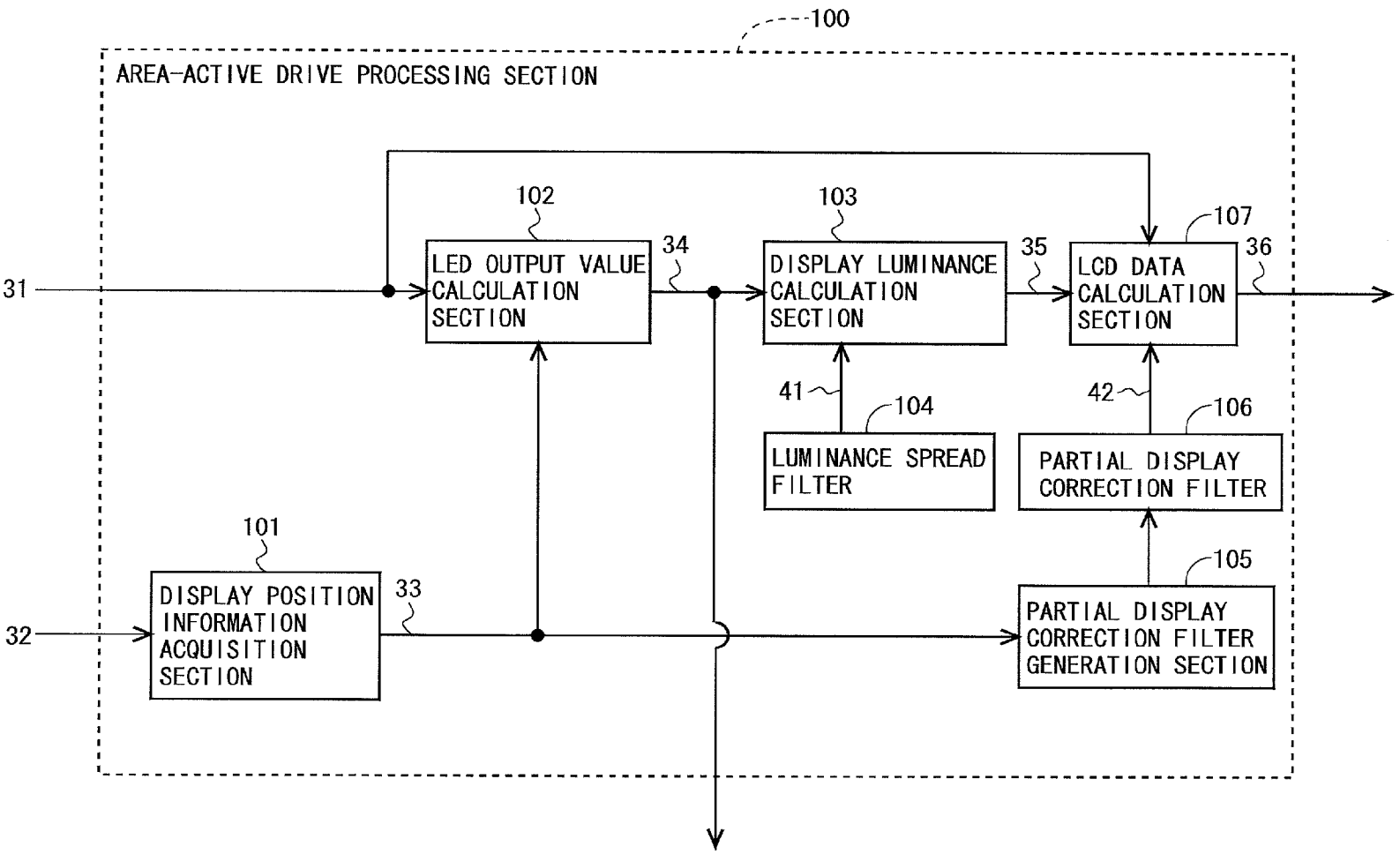
FIG. 1 is a block diagram illustrating a detailed configuration of an area-active drive processing section in a first embodiment of the present invention.

FIG. 1 is a block diagram illustrating a detailed configuration of the area-active drive processing section 100 in the present embodiment. The area-active drive processing section 100 includes, as components for performing a predetermined process, a display position information acquisition section 101, an LED output value calculation section 102, a display luminance calculation section 103, a partial display correction filter generation section 105, and an LCD data calculation section 107, and also includes, as components for storing predetermined data, a luminance spread filter 104 and a partial display correction filter 106. Note that in the present embodiment, the LED output value calculation section 102 realizes an emission luminance calculation section, and the LCD data calculation section 107 realizes a display data calculation section.

The display position information acquisition section 101 receives display position information 32 for identifying an image display position (display range) on the screen, and outputs it as display position identification data 33. The LED output value calculation section 102 divides an input image 31 into a plurality of areas, and obtains LED data (emission luminance data) 34 indicating luminances upon emission of LEDs corresponding to the areas. At this time, on the basis of the display position identification data 33, the LED output value calculation section 102 sets values (LED output values) of luminances upon emission of LEDs corresponding to a non-display area to 0 (light off).

The luminance spread filter 104 has stored therein PSF data, which is data representing the spread of light as numerical values to calculate display luminance for each area, as shown in FIG. 5. Specifically, values of luminances appearing in an area and its surrounding areas in the case where the luminance appearing in that area is assumed to take a value of "100" when LEDs in that area emit light are stored in the luminance spread filter 104 as the PSF data. On the basis of the LED data 34 calculated by the LED output value calculation section 102 and the PSF data 41 stored in the luminance spread filter 104, the display luminance calculation section 103 calculates luminances (hereinafter, referred to as "display luminances") that can be achieved upon display (or estimated to be achieved upon display) in areas by all LEDs to be lit up emitting light.

Figure 7:
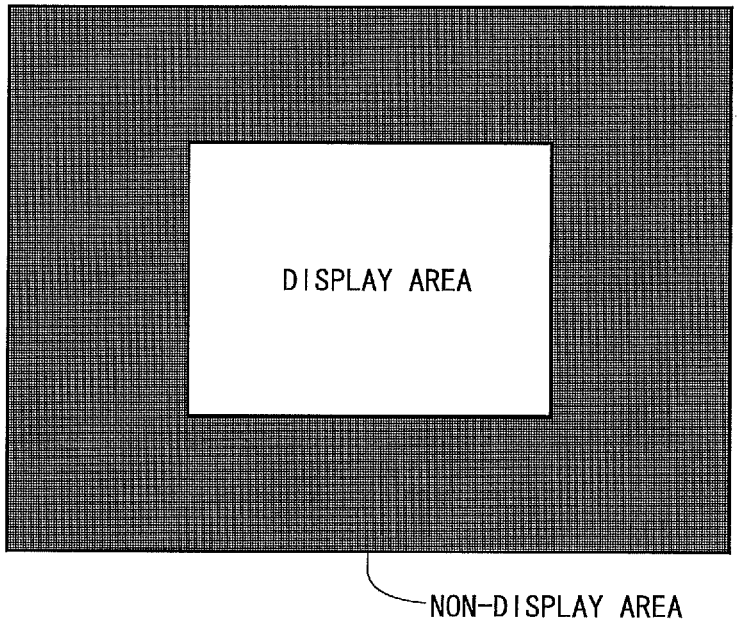
FIG. 7 is a diagram describing partial display in the first embodiment.

The partial display correction filter generation section 105 generates the partial display correction filter 106 for use in calculating the liquid crystal data 36, on the basis of the display position identification data 33. The partial display correction filter 106 has stored therein numerical data (hereinafter, referred to as "correction data") for preventing overflow (digit overflow) from occurring in calculating liquid crystal data 36 when performing partial display. In the present embodiment, in the case of partial display as shown in FIG. 7, the partial display correction filter 106 is, for example, as shown in FIG. 8. In the present embodiment, as shown in FIG. 8, the partial display correction filter 106 has stored therein correction data in association with each pixel, the correction data being intended for use in calculating liquid crystal data 36 for that pixel. Note that in FIG. 8, not all pixels are shown for convenience of explanation. The partial display correction filter 106 will be described in detail later.

The LCD data calculation section 107 obtains liquid crystal data 36 representing light transmittances of all display elements 21 included in the liquid crystal panel 11, on the basis of the input image 31, the display luminances 35 calculated by the display luminance calculation section 103, and the correction data 42 stored in the partial display correction filter 106.

<1.3 Partial Display Correction Filter>

As described above, the partial display correction filter 106 is generated on the basis of the display position identification data 33. Accordingly, when the display position identification data 33 indicates partial display as shown in FIG. 7 to be provided, the partial display correction filter generation section 105 generates the partial display correction filter 106 as shown in FIG. 8, for example. Alternatively, when the display position identification data 33 indicates, for example, partial display to be provided in the lower left of the screen, the partial display correction filter generation section 105 generates the partial display correction filter 106 as shown in FIG. 9, for example. Note that in FIG. 9, not all pixels are shown for convenience of explanation, as in the case of FIG. 8.

Figure 10A:
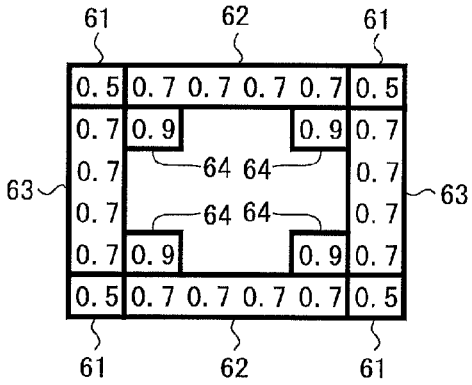
FIGS. 10A and 10B are diagrams describing generation of a partial display correction filter in the first embodiment.
Figure 10B:
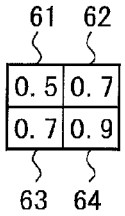
Figure 11:
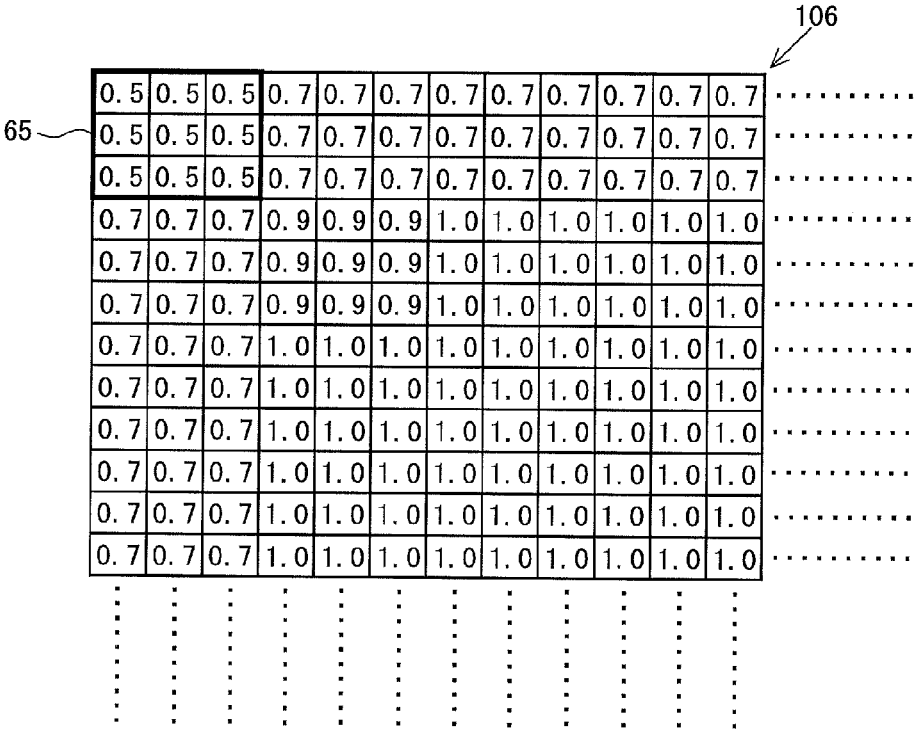
FIG. 11 is a diagram illustrating an example of the partial display correction filter in the first embodiment where correction data values corresponding to a plurality of pixels inward from each outer edge of a display area are set at values other than 1.0.

By the way, in the case where values of correction data to be stored in the partial display correction filter 106 may be predetermined value regardless of the position and the size of the display area (on the screen) when performing partial display, the partial display correction filter generation section 105 simply holds numerical data that can be values of the correction data, such that the partial display correction filter 106 can be generated on the basis of the display position identification data 33. For example, looking at correction data values for display areas in FIGS. 8 and 9, they are as shown in FIG. 10A (note that "1.0" is omitted). As can be appreciated from FIG. 10A, in the present embodiment, correction data values are 0.5 for the four corners (portions denoted by character "61") of the display area, 0.7 for upper and lower edges (portions denoted by character "62") of the display area, 0.7 for left and right edges (portions denoted by character "63") of the display area, and 0.9 for portions lying diagonally inside the four corners and close to the center of the display area (portions denoted by character "64"). In addition, other correction data values in the display area are 1.0, and correction data values for the non-display area are 0.0. In this case, the partial display correction filter generation section 105 only has to hold correction data values corresponding to four pixels (or areas) in the upper left corner, for example, of the display area (see FIG. 10B). So long as the data shown in FIG. 10B is held, correction data values can be identified for the four corners of the display area, the upper and lower edges of the display area, the right and left edges of the display area, and the portions lying diagonally inside the four corners and close to the center of the display area, regardless of the position and the size of the display area on the screen, and therefore, the partial display correction filter 106 can be generated without preparing any data or filter other than the data shown in FIG. 10B. Note that in the foregoing description, only the correction data values corresponding to outermost pixels at the edges of the display area (i.e. , one pixel from each) are values other than 1.0 (note that values for the portions denoted by character "64" in FIG. 10A are exceptions), but it is conceivably preferable that correction data values corresponding to anywhere from several to hundreds of pixels inward from each of the outer edges of the display area be set at values other than 1.0 in accordance with the configurations and the characteristics of the liquid crystal panel 11 and the backlight 13. FIG. 11 shows an example of the partial display correction filter 106 where correction data values corresponding to three pixels inward from each of the outer edges of the display area (the number may differ between the vertical direction and the horizontal direction) are set at values other than 1.0. In this case, for example, the portions denoted by character "65" in FIG. 11 correspond to the portions denoted by character "61" in FIGS. 10A and 10B. Note that values in the region denoted by character "65" and in the region whose value is other than 1.0 in FIG. 11 may change so as to gradually increase toward the center. In such a case, the data to be held in the partial display correction filter generation section 105 (see FIG. 10B) may be increased or may be computed by calculation from the values shown in FIG. 10B.

Furthermore, in the case where the liquid crystal display device performs full display (in the case where the display position identification data 33 indicates full display to be performed), the partial display correction filter generation section 105 may generate (or prepare) the partial display correction filter 106, such that correction data values corresponding to all pixels (or areas) are set at 1.0, as shown in FIG. 12. As a result, full display is performed in a similar manner to conventional without data values being unnecessarily corrected in calculating the liquid crystal data 36 when performing full display. Moreover, in the case of a display device, in which its edges (of the display area) become darker compared to the center when performing full display, a partial display correction filter 106 as shown in FIG. 13 may be used in place of the partial display correction filter 106 shown in FIG. 12. As a result, the edges of the display area are inhibited from becoming darker when performing full display. Note that in FIGS. 12 and 13, not all pixels are shown for convenience of explanation.

In the present embodiment, the partial display correction filter 106 is generated on the basis of the display position identification data 33, as described above. Specifically, when an external instruction is given to switch between full display and partial display or change the position/size of the display area for partial display, such an instruction is acquired by the display position information acquisition section 101 as display position information 32. The display position information 32 is then provided to the partial display correction filter generation section 105 as display position identification data 33, and the partial display correction filter generation section 105 generates a partial display correction filter 106. Therefore, for example, when full display is switched to partial display at the center of the screen, the partial display correction filter 106 to be referenced by the LCD data calculation section 107 changes from that shown in FIG. 12 to that shown in FIG. 8.

<1.4 LCD Data Calculation Process>

Figure 14:
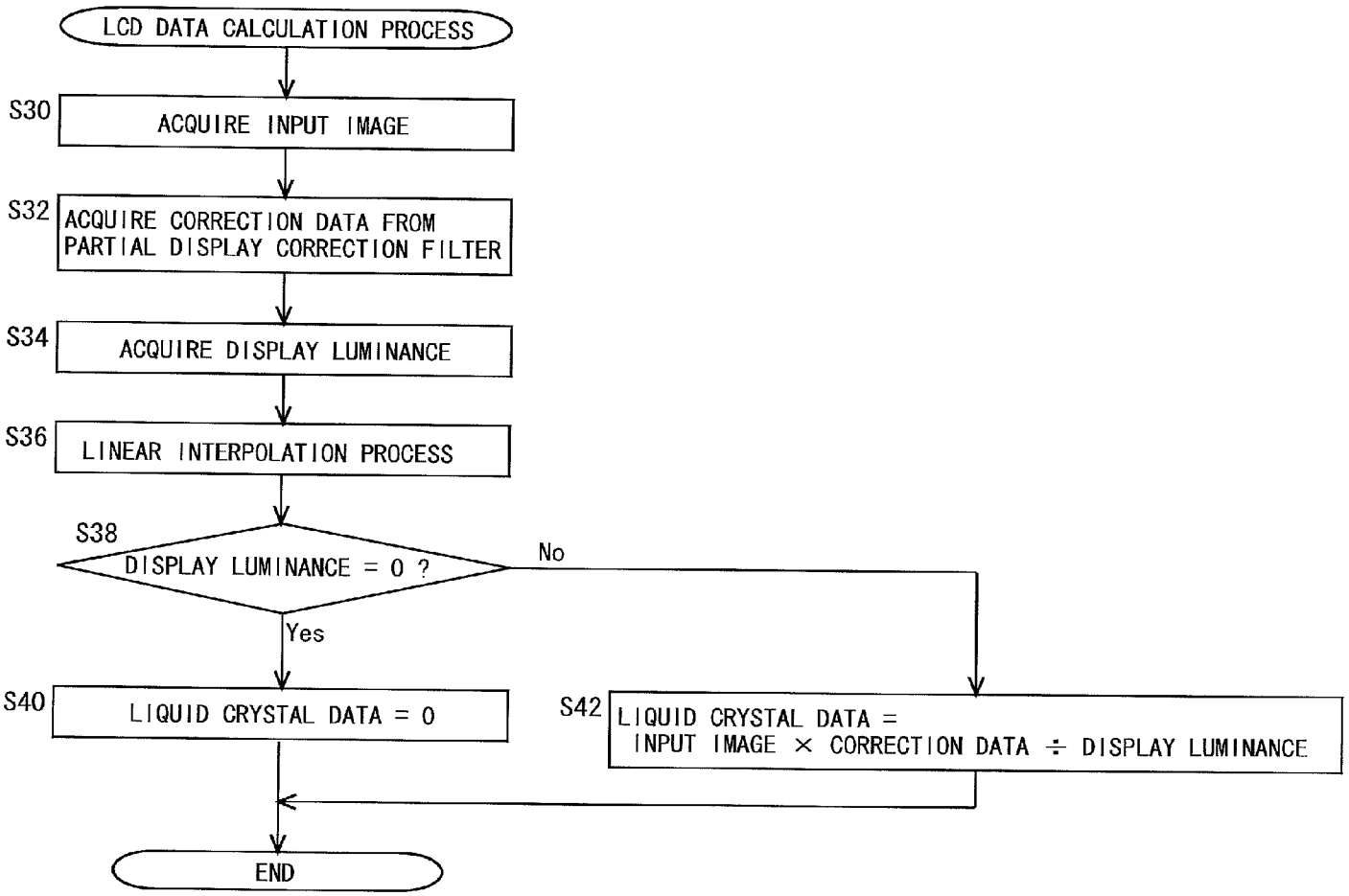
FIG. 14 is a flowchart illustrating the procedure of an LCD data calculation process in the first embodiment.

Described next is the procedure of the LCD data calculation process to be performed by the LCD data calculation section 107. FIG. 14 is a flowchart illustrating the procedure of the LCD data calculation process. First, the LCD data calculation section 107 acquires an externally transmitted input image 31 (step S30). Next, the LCD data calculation section 107 acquires correction data 42 corresponding to each pixel from the partial display correction filter 106 (step S32). Then, the LCD data calculation section 107 acquires display luminances 35 calculated by the display luminance calculation section 103 (step S34). Thereafter, the LCD data calculation section 107 performs a linear interpolation process on the display luminances 35 acquired in step S34, thereby acquiring a display luminance for each pixel (step S36).

Next, the LCD data calculation section 107 determines for each pixel whether its display luminance is 0 or not (step S38). If the result of the determination indicates that the display luminance is 0, the process advances to step S40, and if not, the process advances to step S42. In step S40, the LCD data calculation section 107 sets the value for the liquid crystal data 36 of any pixel being processed to 0. In step S42, the LCD data calculation section 107 calculates the value Dlcd for the liquid crystal data 36 of any pixel being processed by equation (1) below.

$$Dlcd = Din \times Dh \div BR \tag{1}$$

Here, Din is a pixel value for the input image 31, Dh is a value for correction data 42, and BR is a display luminance value.

The LCD data calculation process ends upon completion of step S40 or S42. Note that the processing from step S38 to step S40 or S42 is repeated the same number of times as the number of pixels in the panel of the liquid crystal display device. That is, the LCD data calculation process generates the same number of pieces of liquid crystal data 36 as the number of pixels in the panel of the liquid crystal display device.

<1.5 Effect>

Figure 15:
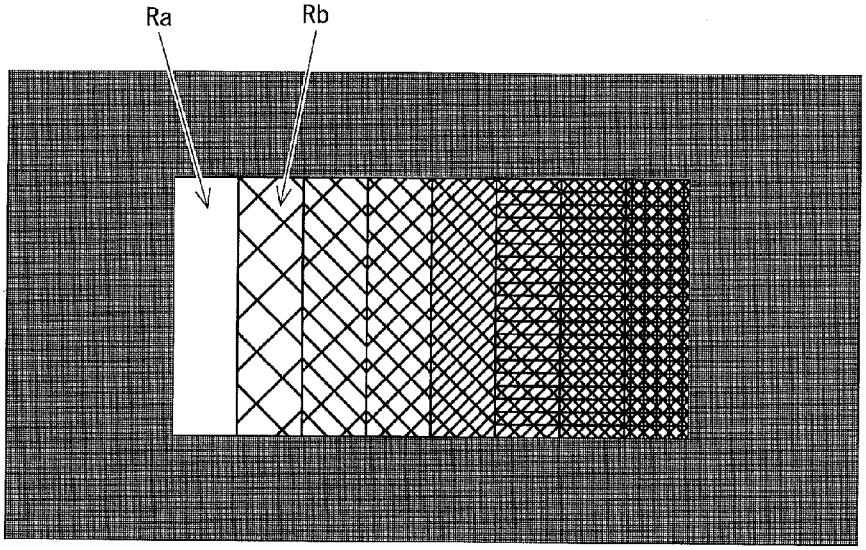
FIG. 15 is a diagram describing an effect of the first embodiment.

Described next is an effect of the present embodiment. It is assumed here that gradation display as shown in FIG. 15 is performed at the center of the display portion. Moreover, in this description, maximum possible values of input data (pixel values of the input image 31), display luminances, and liquid crystal data are assumed to be 1.0 for convenience. In addition, it is assumed that input data for a region denoted by character "Ra" in FIG. 15 is 1.0, and input data for a region denoted by character "Rb" in FIG. 15 is 0.9.

First, referring to FIG. 16, a first comparative example will be described with respect to an operation of a conventional liquid crystal display device where LEDs are lit up in a considerably wider range than the display area. Note that FIG. 16 schematically shows input data, a distribution of luminances (display luminances) obtained by backlight, liquid crystal data, combined luminances for backlight lights and liquid crystal data, and a display image, for the case where the aforementioned gradation display is performed (same for FIGS. 17, 18, 24, 25, and 26).

Figure 16:
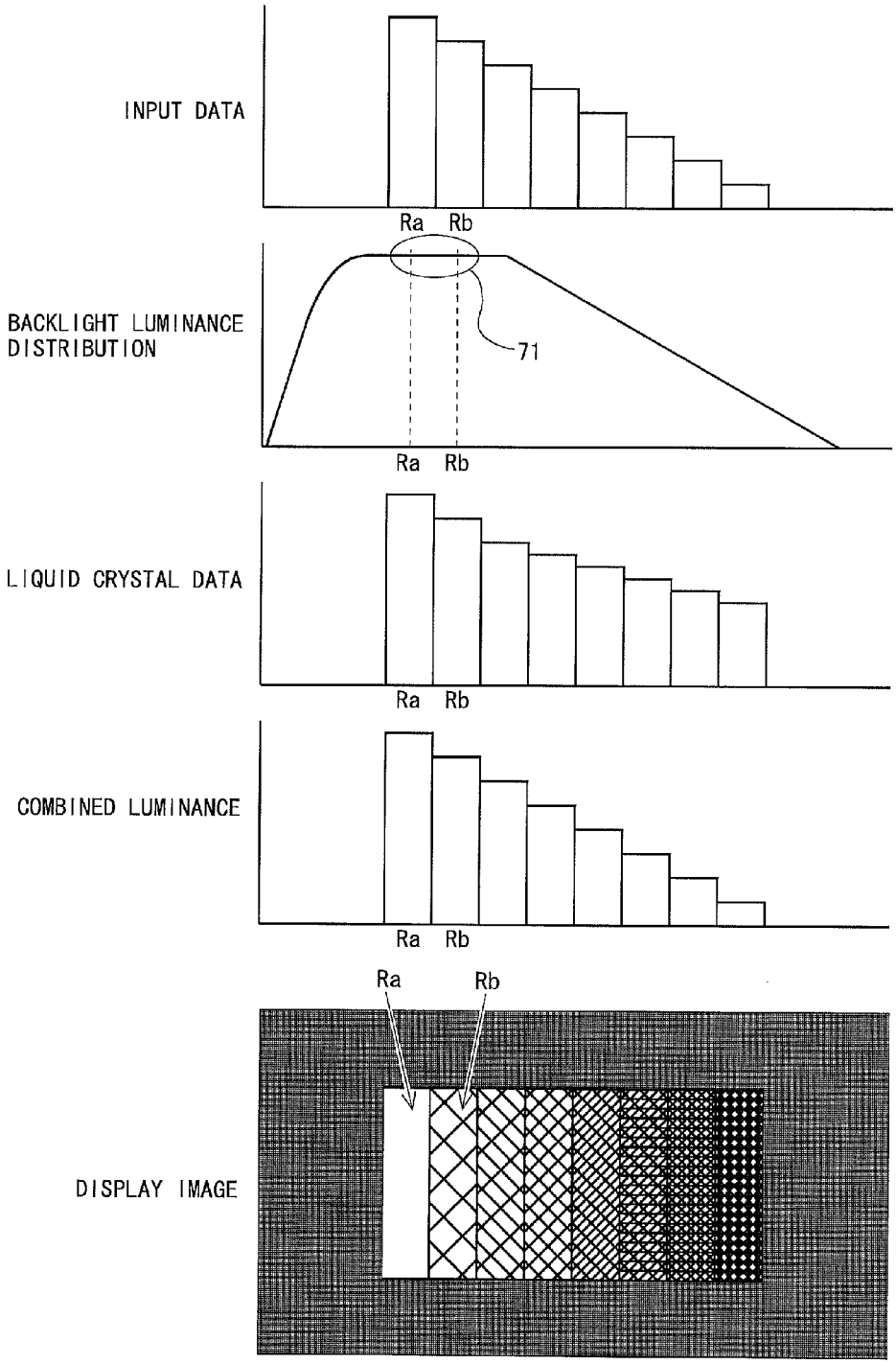
FIG. 16 is a diagram describing an effect of the first embodiment.

When the LEDs are lit up in the considerably wider range than the display area, display luminances are 1.0 both in region Ra and region Rb (see a portion denoted by character "71" in FIG. 16). Moreover, in the conventional liquid crystal display device, the value Dlcd of the liquid crystal data 36 is calculated by equation (2) below where the input data is Din and the display luminance is BR.

$$Dlcd = Din \div BR \tag{2}$$

Accordingly, the value DRa of the liquid crystal data 36 for region Ra is calculated as shown in equation (3) below, and the value DRb of the liquid crystal data 36 for region Rb is calculated as shown in equation (4) below.

$$\begin{aligned} DRa &= 1.0 \div 1.0 \\ &= 1.0 \end{aligned} \tag{3}$$

$$\begin{aligned} DRb &= 0.9 \div 1.0 \\ &= 0.9 \end{aligned} \tag{4}$$

In this manner, in the first comparative example, the difference in tone is correctly maintained between regions Ra and Rb, so that gradation display can be normally performed. However, since the LEDs lights up in a considerably wider range than the display area, power consumption is high.

Figure 17:
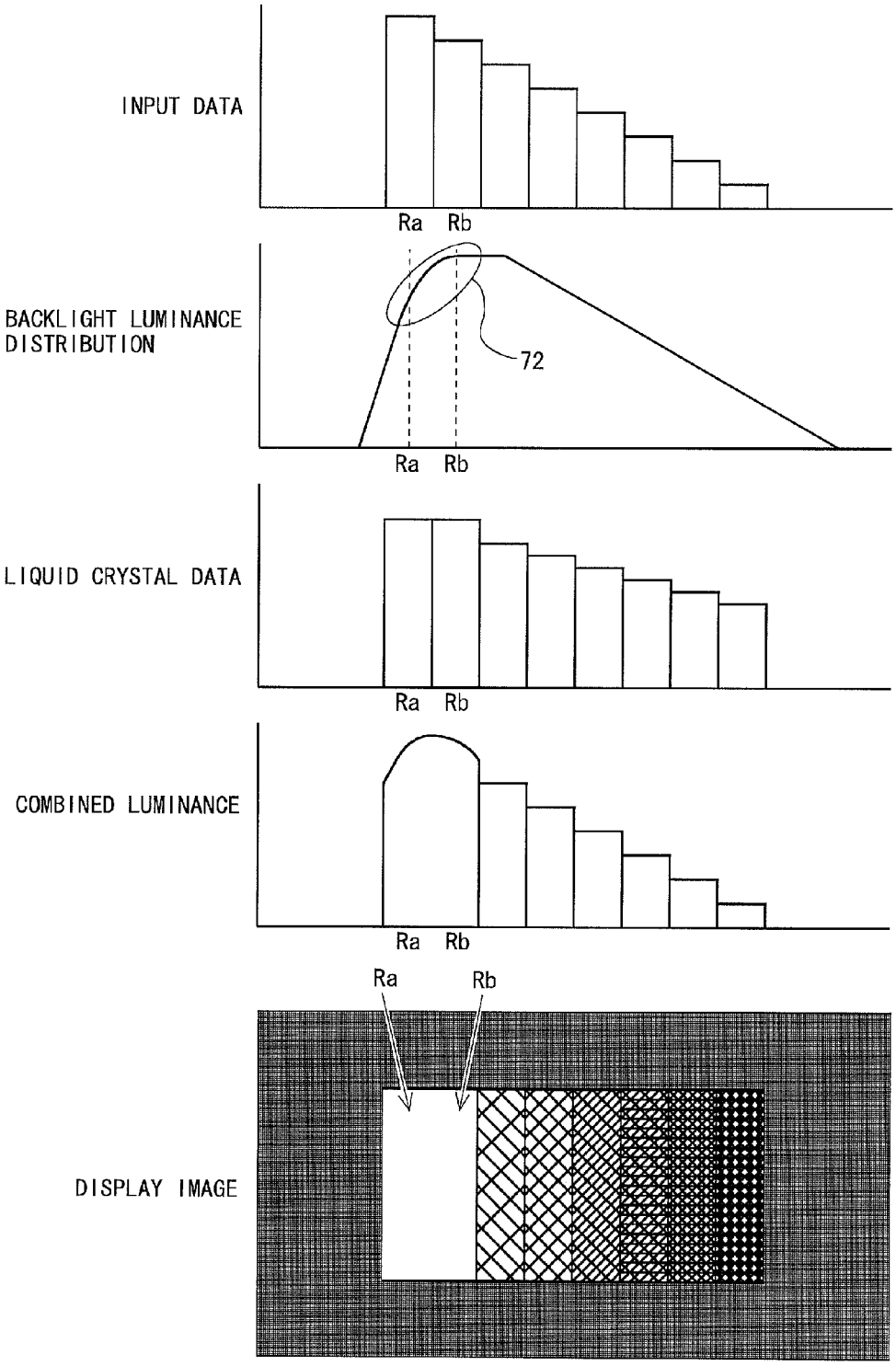
FIG. 17 is a diagram describing an effect of the first embodiment.

Next, referring to FIG. 17, a second comparative example will be described with respect to an operation of the conventional liquid crystal display device where LEDs are lit up in a range approximately equal to the display area. When the LEDs are lit up in the range approximately equal to the display area, for example, the display luminance in region Ra is 0.8 and the display luminance in region Rb is 0.9 (see a portion denoted by character "72" in FIG. 17). The value of liquid crystal data 36 is calculated by equation (2). Accordingly, the value $D_{Ra}$ of the liquid crystal data 36 for region Ra is calculated as shown in equation (5) below, and the value DRb of the liquid crystal data 36 for region Rb is calculated as shown in equation (6) below.

$$DRa = 1.0 \div 0.8 = 1.25 \quad (5)$$

$$DRb = 0.9 \div 0.9 = 1.0 \quad (6)$$

In equation (5), the value DRa of the liquid crystal data 36 for region Ra is 1.25. However, any values exceeding 1.0 are rounded to 1.0, and therefore, the value DRa of the liquid crystal data 36 for region Ra is 1.0. As a result, the value DRa of the liquid crystal data 36 for region Ra and the value DRb of the liquid crystal data 36 for region Rb are equalized; so that the difference in tone between regions Ra and Rb is not correctly maintained. Consequently, in the second comparative example, desired gradation display is not achieved.

Figure 18:
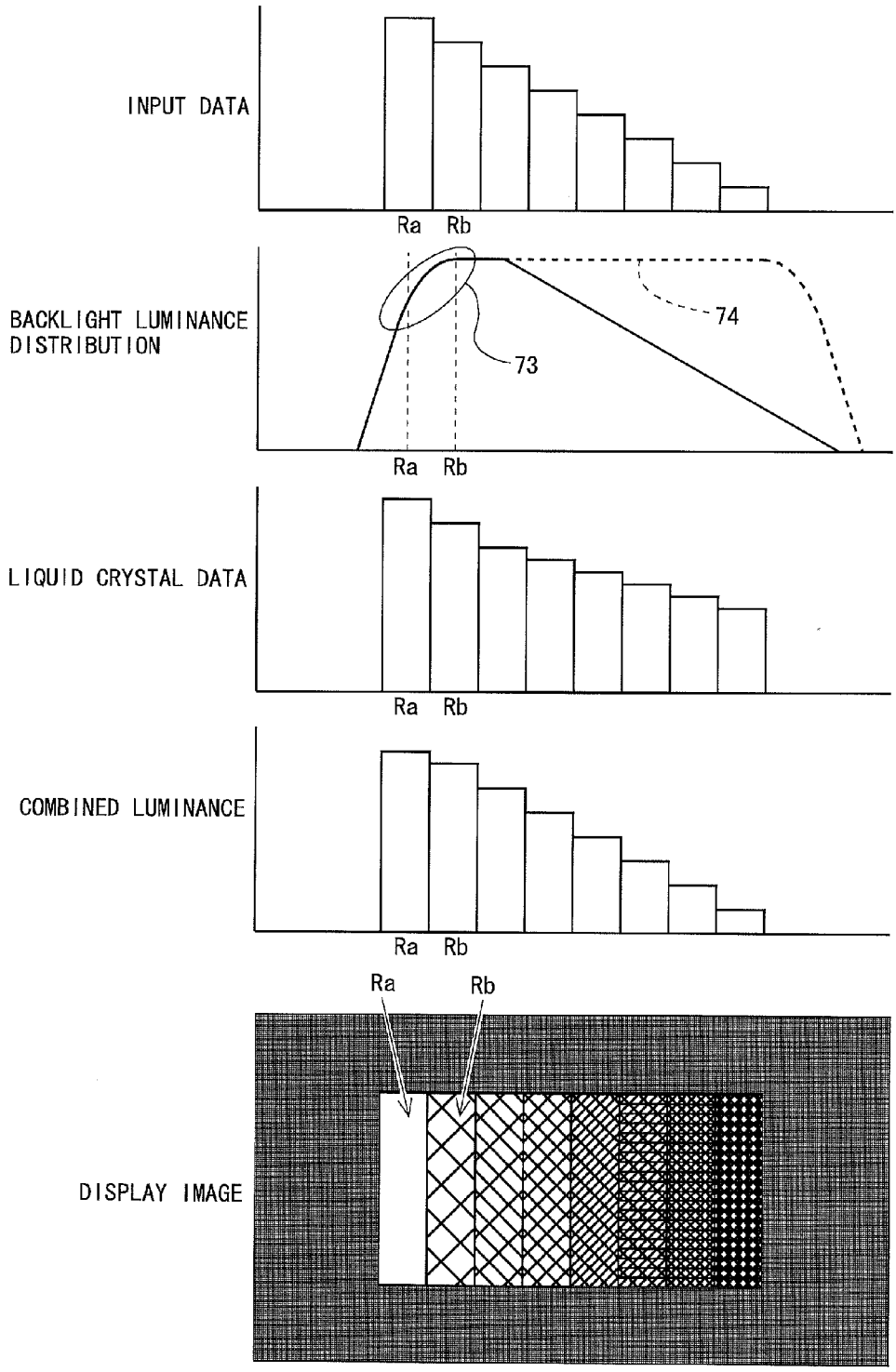
FIG. 18 is a diagram describing an effect of the first embodiment.

Next, the operation of the present embodiment will be described with reference to FIG. 18. Note that the dotted line denoted by character "74" in FIG. 18 represents values of correction data 42 to be stored in the partial display correction filter 106 for partial display. In the present embodiment,. since the LEDs are lit up in a range approximately equal to the display area, the display luminance in region Ra is 0.8, and the display luminance in region Rb is 0.9 (see a portion denoted by character "73" in FIG. 18). The value of liquid crystal data 36 is calculated by equation (1). Here, the value of the correction data 42 is, for example, 0.8 for region Ra and 0.9 for region Rb. Accordingly, the value DRa of the liquid crystal data 36 for region Ra is calculated as shown in equation (7) below, and the value DRb of the liquid crystal data 36 for region Rb is calculated as shown in equation (8) below.

$$DRa = 1.0 \times 0.8 \div 0.8 = 1.0 \quad (7)$$

$$DRb = 0.9 \times 0.9 \div 0.9 = 0.9 \quad (8)$$

In this manner, the value DRa of the liquid crystal data 36 for region Ra is set to 1.0, and the value DRb of the liquid crystal data 36 for region Rb is set to 0.9. As a result, the difference in tone between regions Ra and Rb is correctly maintained, so that gradation display can be normally performed. In addition, unlike in the first comparative example, LEDs are lit up only within a range approximately equal to the display area. Thus, power consumption is reduced to be lower than conventional.

As described above, in the present embodiment, LEDs are lit up only within a range approximately equal to the display area when performing partial display. In addition, the partial display correction filter 106 having values of 1.0 or less stored as correction data 42 is generated on the basis of the position and the size of the display area, and when calculating the liquid crystal data 36, values of input data (pixel values of the input image 31) are multiplied by the values of the correction data 42. Thus, the values of the input data are reduced on the basis of the correction data 42. Here, the liquid crystal data 36 is calculated by dividing the values of the input data by display luminance values, and in the present embodiment, the values of the input data are reduced on the basis of the correction data 42, as described above. As a result, even in regions with relatively low display luminances, such as portions close to the edges of the display area, overflow is inhibited from occurring when dividing values of input data by display luminance values. Thus, low power consumption can be achieved in the display device which performs area-active drive without causing any display failure in performing partial display.

Furthermore, in the present embodiment, the LCD data calculation process branches out in accordance with whether the display luminance of each pixel is 0 or not (step S38 of FIG. 14). If the display luminance of a pixel being processed is 0, the value of the liquid crystal data 36 for that pixel is set to 0 without going through equation (1). In this manner, it is possible to prevent a so-called "division by zero" from occurring when calculating the liquid crystal data 36. Thus, it is possible to prevent the display device from operating abnormally due to display luminances of pixels in the non-display area being 0.

<1.6 Variant>

In the above embodiment, when switching between full display and partial display, the partial display correction filter is switched between for full display (e.g., the filter shown in FIG. 12) and for partial display (e.g., the filter shown in FIG. 8). In this regard, to inhibit the display image from changing abruptly, the partial display correction filter may be gradually switched between for full display and for partial display. Specifically, the LCD data calculation section 107 may sequentially refer to a plurality of partial display correction filters having stored therein their respective different patterns of correction values (values of correction data 42). Concretely, when switching from the filter shown in FIG. 12 to the filter shown in FIG. 8, the LCD data calculation section 107 sequentially refers to filters shown in FIGS. 19A, 193, and 19C as partial display correction filters 106. In this manner, when switching from full display to partial display or switching from partial display to full display, the values of correction data 42 stored in the partial display correction filter 106 gradually change. As a result, the display image is inhibited from abruptly changing, so that switching between full display and partial display can be performed without causing the display to be unnatural to the human eye. Note that as for the filters shown in FIGS. 19A and 19B, values of correction data for a portion corresponding to the display area are set at 1.0 to simplify the circuit configuration. Moreover, in the case of a display device with the edges (of the display area) becoming darker than the center when performing full display, values of correction data for the edges of the filters shown in FIGS. 19A and 19B may be set to values other than 1.0, as in the case of the partial display correction filter 106 shown in FIG. 13.

<2. Second Embodiment>

<2.1 Configuration>

Figure 20:
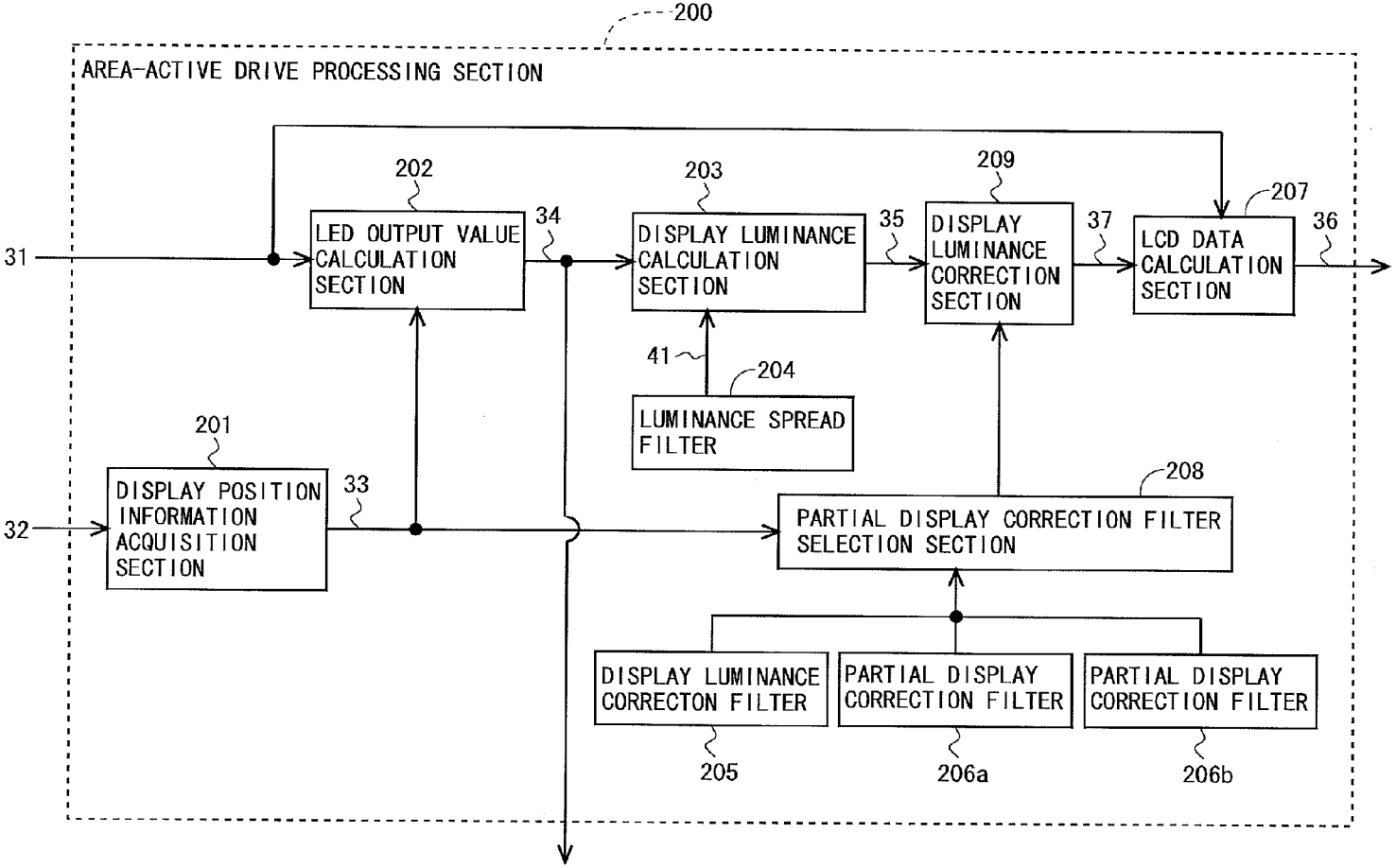
FIG. 20 is a block diagram illustrating a detailed configuration of an area-active drive processing section in a second embodiment of the present invention.

FIG. 20 is a block diagram illustrating a detailed configuration of an area-active drive processing section 200 according to a second embodiment of the present invention. Note that the overall configuration is the same as in the first embodiment, and therefore, any description thereof will be omitted. The area-active drive processing section 200 includes, as components for performing a predetermined process, a display position information acquisition section 201, an LED output value calculation section 202, a display luminance calculation section 203, a partial display correction filter selection section 208, a display luminance correction section 209, and an LCD data calculation section 207 and also includes, as components for storing predetermined data, a luminance spread filter 204, a display luminance correction filter 205, and partial display correction filters 206*a* and 206*b*. Note that in the present embodiment, the LED output value calculation section 202 realizes an emission luminance calculation section, and the LCD data calculation section 207 realizes a display data calculation section. In addition, the partial display correction filter selection section 208 realizes a correction filter selection section.

The operations of the display position information acquisition section 201, the LED output value calculation section 202, and the display luminance calculation section 203, and the content of data stored in the luminance spread filter 204 are the same as in the first embodiment, and therefore, any descriptions thereof will be omitted.

The display luminance correction filter 205 has stored therein data for correcting the display luminances 35 calculated by the display luminance calculation section 203 when performing full display. In the present embodiment, the display luminance correction filter 205 is as shown in FIG. 21. The display luminance correction filter 205 has numerical data stored therein as correction data in association with each area, the numerical data being intended for use in correcting the display luminances 35 for that area. In the present embodiment, as shown in FIG. 21, correction data values are 2.0 for the four corners of the display area, 1.4 for the upper and lower edges of the display area, 1.4 for the left and right edges of the display area, and 1.1 for portions lying diagonally inside the four corners and close to the center of the display area. Moreover, correction data values are 1.0 for other portions of the display area.

The partial display correction filters 206*a* and 206*b* have stored therein data for correcting the display luminances 35 calculated by the display luminance calculation section 203 when performing partial display. In the present embodiment, the partial display correction filter 206*a* is as shown in FIG. 22, and the partial display correction filter 206*b* is as shown in FIG. 23. As in the case of the display luminance correction filter 205, the partial display correction filters 206*a* and 206*b* have numerical data stored therein as correction data in association with each area, the numerical data being intended for use in correcting the display luminances 35 for that area. Note that unlike in the first embodiment, values of the correction data stored in the partial display correction filters are 1.0 or more.

The partial display correction filter selection section 208 selects a filter to be referenced by the display luminance correction section 209, on the basis of the display position identification data 33. Concretely, when the display position identification data 33 indicates full display to be performed, the partial display correction filter selection section 208 selects the display luminance correction filter 205. Alternatively, when the display position identification data 33 indicates partial display to be performed on the center of the screen, the partial display correction filter selection section 208 selects the partial display correction filter 206*a*. Alternatively still, when the display position identification data 33 indicates partial display to be performed in the lower left of the screen, the partial display correction filter selection section 208 selects the partial display correction filter 206*b*. Note that in the present embodiment, only the two types of partial display correction filters 206*a* and 206*b* are prepared, but the present invention is not limited to this, and three or more types of partial display correction filters may be prepared in accordance with forms of partial display to be performed by the display device.

The display luminance correction section 209 corrects the display luminances 35 calculated by the display luminance calculation section 203 , on the basis of correction data 43 stored in the filter selected by the partial display correction filter selection section 208. The correction is performed by multiplying the display luminances 35 by values of the correction data 43. Concretely, where the value of correction data 43 is Dh and the display luminance 35 before correction is BR, the display luminance BRh after correction is calculated by equation (9) below.

$$BRh=BR\times Dh \tag{9}$$

That is, the product of the display luminance 35 calculated by the display luminance calculation section 203 and the value of the correction data 43 is the display luminance 37 after correction.

The LCD data calculation section 207 obtains liquid crystal data 36, which represents light transmittances of all display elements 21 included within the liquid crystal panel 11, on the basis of the input image 31 and the display luminance 37 after correction, obtained by the display luminance correction section 209. Concretely, the LCD data calculation section 107 calculates the value Dlcd of the liquid crystal data 36 by equation (10) below.

$$Dlcd=Din+BRh \tag{10}$$

Here, Din is a pixel value of the input image 31.

<2.2 Partial Display Correction Filter>

In the present embodiment, there are prepared the partial display correction filter 206*a* to be referenced by the display luminance correction section 209 when partial display is performed at the center of the screen and partial display correction filter 206*b* to be referenced by the display luminance correction section 209 when partial display is performed in the lower left of the screen. As can be appreciated from FIGS. 22 and 23, values of the correction data 43 stored in the partial display correction filters 206*a* and 206*b* are as described below. Values of the correction data 43 are 2.0 for the four corners of the display area, 1.4 for the upper and lower edges of the display area, 1.4 for the left and right edges of the display area, and 1.1 for portions lying diagonally inside the four corners and close to the center of the display area. In addition, values of the correction data 43 for the non-display area are equal to values of the correction data 43 stored in the display luminance correction filter 205 to be referenced by the display luminance correction section 209 when performing full display.

Note that in FIGS. 21 to 23, not all pixels are shown for convenience of explanation.

By the way, in the first embodiment, the values of the correction data 42 stored in the partial display correction filter 106 are 1.0 or less. On the other hand, in the present embodiment, the values of the correction data 43 stored in the partial display correction filters 206*a* and 206*b* are greater than 1.0. The reason for this is as follows. In the present embodiment, the display luminance correction section 209 corrects the display luminance in accordance with equation (9), and the LCD data calculation section 207 calculates the value Dlcd of the liquid crystal data 36 in accordance with equation (10). Here, from equations (9) and (10), the following equation (11) is established.

$$Dlcd=Din+(BR\times Dh) \tag{11}$$

On the other hand, in the first embodiment, the value Dlcd of the liquid crystal data 36 is calculated by equation (1).

Looking at Dh in equations (1) and (11), it is a factor of the numerator Din in equation (1), whereas it is a factor of the denominator BR in equation (11). Accordingly, the value Dh of the correction data 42 in the first embodiment and the value Dh of the correction data 43 in the present embodiment must be in the reciprocal relationship to each other. Therefore, the values of the correction data 43 for the display area in the partial display correction filters 206*a* and 206*b* are set to be greater than 1.0 as reciprocals of the values of the correction data 42 for the display area in the partial display correction filter 106.

Note that in the present embodiment, the values of the correction data 43 for the non-display area in the partial display correction filters 206*a* and 206*b* are equal to the values of the correction data 43 in the display luminance correction filter 205, but the present invention is not limited to this. As for the non-display area, since the pixel value Din of the input image 31 provided to the LCD data calculation section 207 is 0 and therefore the value Dlcd of the liquid crystal data 36 is 0, the correction data 43 for the non-display area in the partial display correction filters 206*a* and 206*b* may take any value other than 0. The reason that the correction data 43 in the partial display correction filters 206*a* and 206*b* is not allowed to take the value of 0 is to prevent occurrence of a so-called "division by zero", as can be appreciated from equations (9) to (11).

<2.3 Effect>

Described next is an effect of the present embodiment. It is assumed here that the gradation display as shown in FIG. 15 is performed at the center of the display portion. Moreover, in this description, maximum possible values of input data (pixel values of the input image 31), display luminances, and liquid crystal data are assumed to be 1.0 for convenience. In addition, it is assumed that input data for a region denoted by character "Ra" in FIG. 15 is 1.0, and input data for a region denoted by character "Rb" in FIG. 15 is 0.9.

Figure 24:
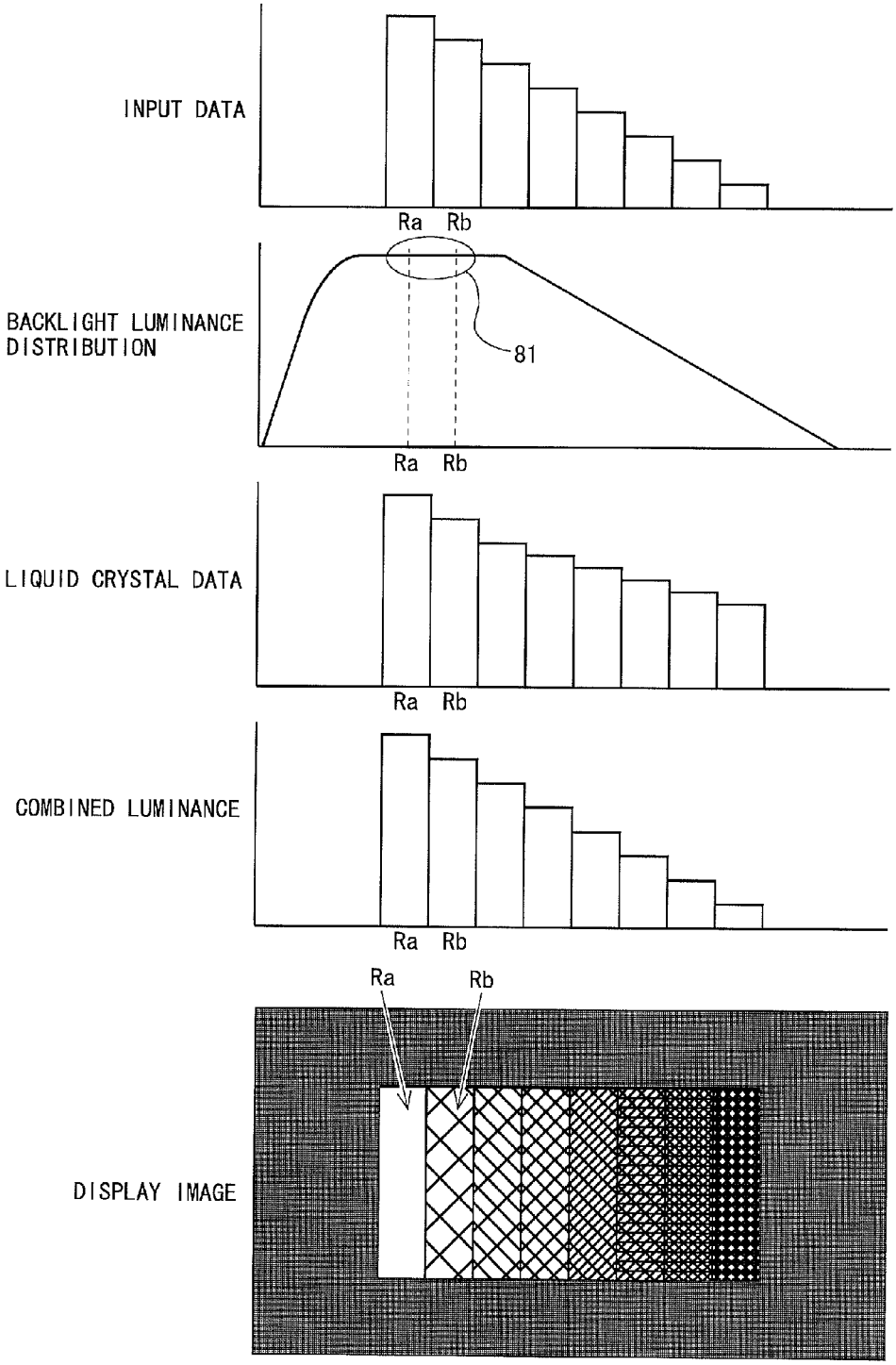
FIG. 24 is a diagram describing an effect of the second embodiment.

First, referring to FIG. 24, a first comparative example will be described with respect to an operation of a conventional liquid crystal display device where LEDs are lit up in a considerably wider range than the display area. When the LEDs are lit up in the considerably wider range than the display area, display luminances are 1.0 both in region Ra and region Rb (see a portion denoted by character "81" in FIG. 24). Moreover, in the conventional liquid crystal display device, the value Dlcd of the liquid crystal data 36 is calculated by equation (12) below where the input data is Din, the display luminance is BR, and the value of the correction data is Dh.

$$Dlcd = Din \div (BR \times Dh) \tag{12}$$

Note that in the conventional liquid crystal display device, the filter as shown in FIG. 21 is used for correcting the display luminances 35, regardless of whether full display or partial display is performed. In addition, the value of the correction data is 1.0 both in region Ra and region Rb. Accordingly, the value DRa of the liquid crystal data 36 for region Ra is calculated as shown in equation (13) below, and the value DRb of the liquid crystal data 36 for region Rb is calculated as shown in equation (14) below.

$$\begin{aligned} DRa &= 1.0 \div (1.0 \times 1.0) \\ &= 1.0 \end{aligned} \tag{13}$$

-continued $$\begin{aligned} DRb &= 0.9 \div (1.0 \times 1.0) \\ &= 0.9 \end{aligned} \tag{14}$$

In this manner, in the first comparative example, the difference in tone is correctly maintained between regions Ra and Rb, so that gradation display can be normally performed. However, lighting up the LEDs in a considerably wider range than the display area results in high power consumption.

Figure 25:
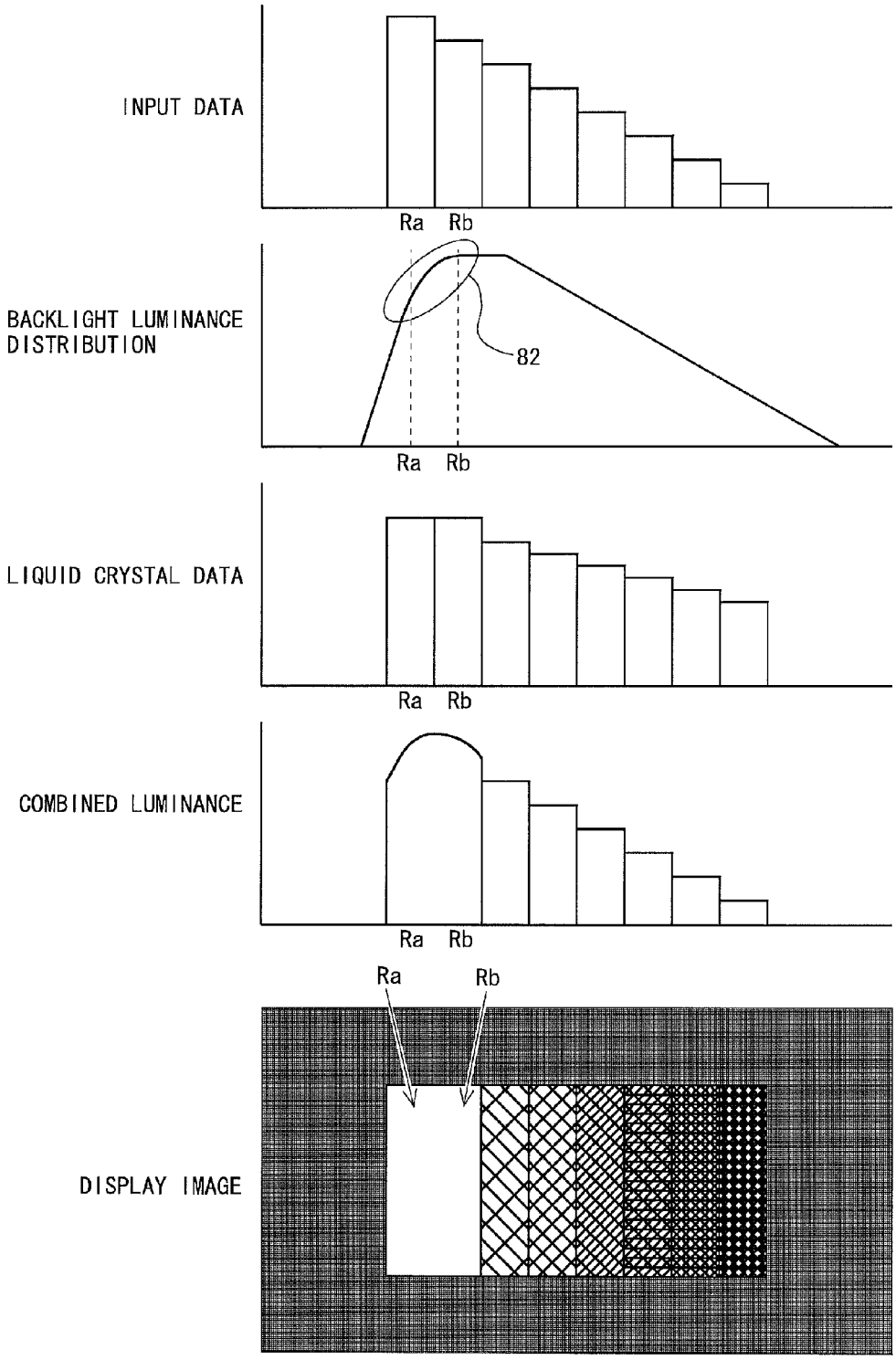
FIG. 25 is a diagram describing an effect of the second embodiment.

Next, referring to FIG. 25, a second comparative example will be described with respect to an operation of the conventional liquid crystal display device where LEDs are lit up in a range approximately equal to the display area. When the LEDs are lit up in the range approximately equal to the display area, for example, the display luminance in region Ra is 0.8 and the display luminance in region Rb is 0.9 (see a portion denoted by character "82" in FIG. 25). The value of liquid crystal data 36 is calculated by equation (12). Accordingly, the value DRa of the liquid crystal data 36 for region Ra is calculated as shown in equation (15) below, and the value DRb of the liquid crystal data 36 for region Rb is calculated as shown in equation (16) below.

$$\begin{aligned} DRa &= 1.0 \div (0.8 \times 1.0) \\ &= 1.25 \end{aligned} \tag{15}$$

$$\begin{aligned} DRb &= 0.9 \div (0.9 \times 1.0) \\ &= 1.0 \end{aligned} \tag{16}$$

In equation (15), the value DRa of the liquid crystal data 36 for region Ra is 1.25. However, any values exceeding 1.0 are rounded to 1.0, and therefore, the value DRa of the liquid crystal data 36 for region Ra is 1.0. As a result, the value DRa of the liquid crystal data 36 for region Ra and the value DRb of the liquid crystal data 36 for region Rb are equalized, so that the difference in tone between regions Ra and Rb is not correctly maintained. Consequently, in the second comparative example, desired gradation display is not achieved.

Figure 26:
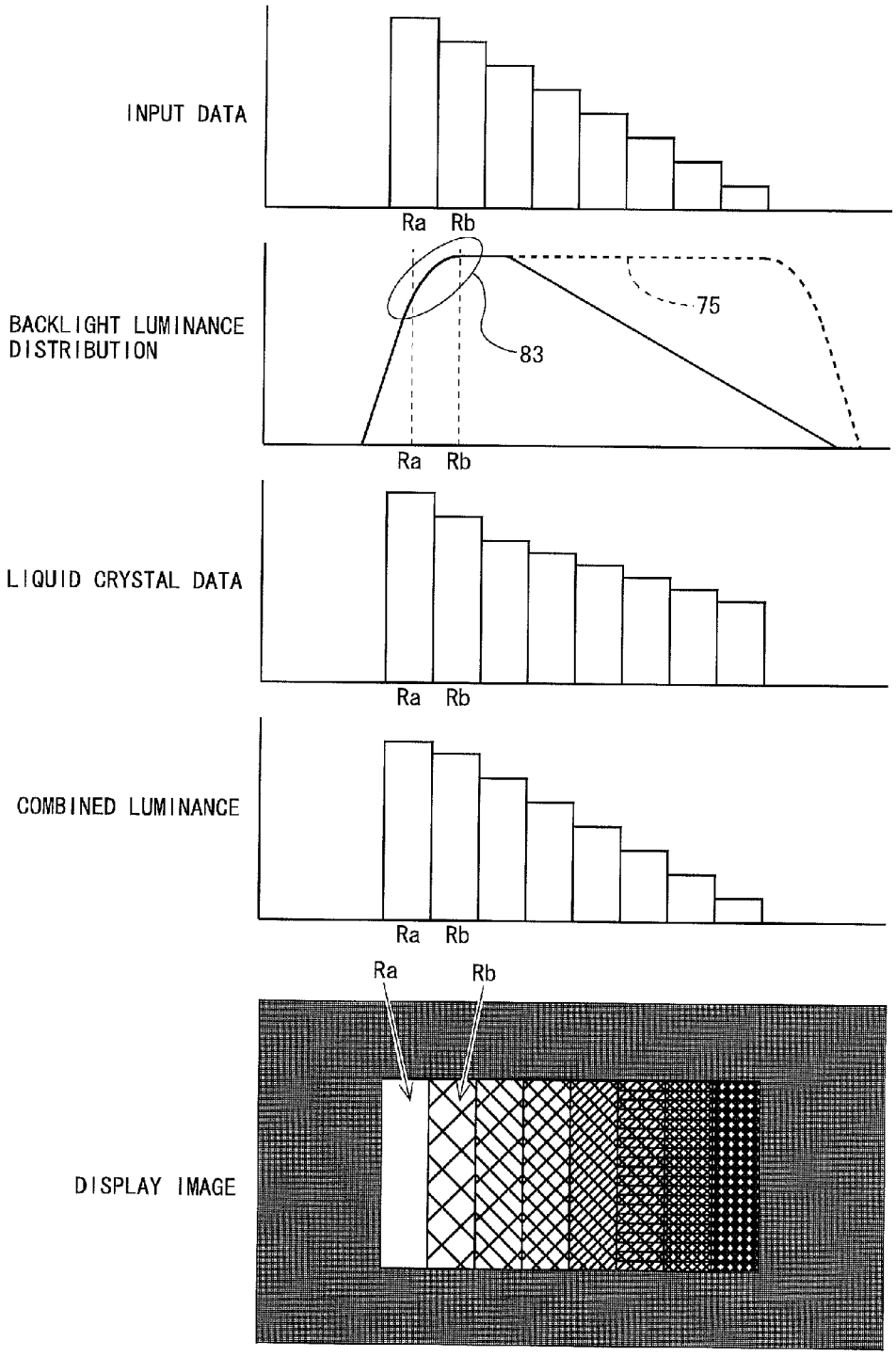
FIG. 26 is a diagram describing an effect of the second embodiment.

Next, the operation of the present embodiment will be described with reference to FIG. 26. Note that the dotted line denoted by character "75" in FIG. 26 represents values of correction data to be stored in a filter to be selected by the partial display correction filter selection section 208 when performing partial display. In the present embodiment, since the LEDs are lit up in a range approximately equal to the display area, the display luminance for region Ra is 0.8, and the display luminance for region Rb is 0.9 (see a portion denoted by character "83" in FIG. 26). The value of liquid crystal data 36 is calculated by equation (11). Here, the value of the correction data 43 is, for example, 1.25 for region Ra and 1.1 for region Rb (these values are reciprocals of the values represented by the dotted line denoted by character "75" in FIG. 26). Accordingly, the value DRa of the liquid crystal data 36 for region Ra is calculated as shown in equation (17) below, and the value DRb of the liquid crystal data 36 for region Rb is calculated as shown in equation (18) below.

$$\begin{aligned} DRa &= 1.0 \div (0.8 \times 1.25) \\ &= 1.0 \end{aligned} \tag{17}$$

-continued $$DRb = 0.9 \div (0.9 \times 1.1) = 0.9 \quad (18)$$

In this manner, the value DRa of the liquid crystal data 36 for region Ra is set to 1.0, and the value DRb of the liquid crystal data 36 for region Rb is set to 0.9. As a result, the difference in tone between regions Ra and Rb is correctly maintained, so that gradation display can be normally performed. In addition, unlike in the first comparative example, LEDs are lit up only within a range approximately equal to the display area. Thus, power consumption is reduced to be lower than conventional.

As described above, in the present embodiment, LEDs are lit up only within a range approximately equal to the display area when performing partial display. In addition, the partial display correction filters 206*a* and 206*b* having values greater than 1.0 stored as correction data 43 are selected on the basis of the position and the size of the display area, and when calculating the liquid crystal data 36, values of the display luminances 35 are multiplied by the values of the correction data 43. Thus, the values of the display luminances 35 are increased on the basis of the correction data 43. Here, the liquid crystal data 36 is calculated by dividing the values of the input data by values of the display luminances 37 after correction, and in the present embodiment, the values of the display luminances are increased on the basis of the correction data 43, as described above. As a result, even in regions with relatively low display luminances, such as portions close to the edges of the display area, overflow is inhibited from occurring when dividing values of input data by display luminance values. Thus, low power consumption can be achieved in the display device which performs area-active drive without causing any display failure in performing partial display.

<3. Third Embodiment>

<3.1 Configuration and Overview of the Operation>

Figure 27:
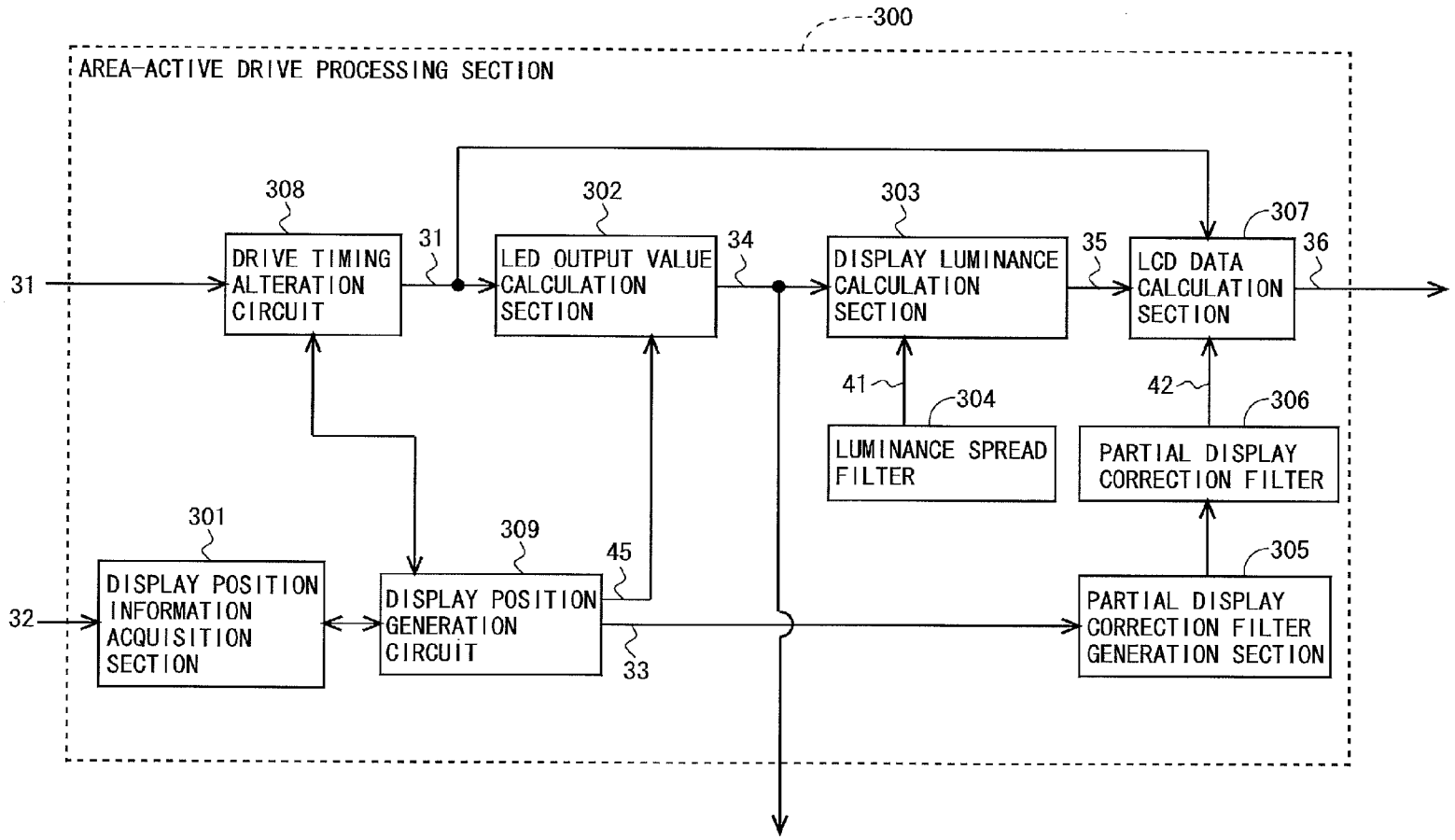
FIG. 27 is a block diagram illustrating a detailed configuration of an area-active drive processing section in a third embodiment of the present invention.

FIG. 27 is a block diagram illustrating a detailed configuration of an area-active drive processing section 300 according to a third embodiment of the present invention. Note that the overall configuration is the same as in the first embodiment, and therefore, any description thereof will be omitted. The, area-active drive processing section 300 includes, as components for performing a predetermined process, a display position information acquisition section 301, a display position generation circuit 309, a drive timing alteration circuit 308, an LED output value calculation section 302, a display luminance calculation section 303, a partial display correction filter generation section 305, and an LCD data calculation section 307 and also includes, as components for storing predetermined data, a luminance spread filter 304 and a partial display correction filter 30G. Note that in the present embodiment, the LED output value calculation section 302 realizes an emission luminance calculation section, the LCD data calculation section 307 realizes a display data calculation section, and the display position generation circuit 309 and the drive timing alteration circuit 308 realize a drive control section.

The operations of the display luminance calculation section 303, the LCD data calculation section 307, and the partial display correction filter generation section 305, and the content of data stored in the luminance spread filter 304 and the partial display correction filter 306 are the same as in the first embodiment, and therefore, any descriptions thereof will be omitted.

The drive timing alteration circuit 308 performs a process for causing an input image 31 to accord with the timing of driving the liquid crystal display device. For example, when the resolution of the input image 31 differs from the resolution of the liquid crystal display device, the drive timing alteration circuit 308 performs a timing adjustment such that the input image 31 is displayed on the liquid crystal display device. For example, when the resolution of the input image 31 is higher than the resolution of the liquid crystal display device, a process of reducing data included in the input image 31 is performed, and when the resolution of the liquid crystal display device is higher than the resolution of the input image 31, a process of inserting data into the input image 31 by data interpolation is performed, or the input image 31 is displayed without its resolution being changed and other areas are displayed in black (non-display). In addition, the drive timing alteration circuit 308 performs a timing adjustment when a plurality of input images 31 are sent from the external (when display called "dual view" or "triple view" is performed) and also detects a non-display area within the input image 31. Moreover, the drive timing alteration circuit 308 outputs the input image 31 subjected to the timing adjustment, on the basis of a display method determined by data exchange with the display position generation circuit 309 to be described later.

The display position generation circuit 309 detects, for example, the size of an available display area on the screen or the feasibility of display on a plurality of screens, on the basis of information provided by the drive timing alteration circuit 308, and provides the detected information to the display position information acquisition section 301. In addition, the display position generation circuit 309 acquires information on a display method selected by the user from the display position information acquisition section 301, and provides the information to the drive timing alteration circuit 308. Moreover, on the basis of the information acquired from the display position information acquisition section 301, the display position generation circuit 309 provides display position identification data 33 to the partial display correction filter generation section 305, defines (optimizes) the boundary between the display area and the non-display area, and provides the LED output value calculation section 302 with a filter (masking filter) 44 as shown in FIG. 28 for turning off LEDs in the non-display area.

The display position information acquisition section 301 is typically configured by a GUI (graphical user interface) screen such that display method selection by the user can be accepted. The GUI screen displays items related to display methods that can be selected by the user, e.g., the size of the display area, the position of the display area, the feasibility of display on a plurality of screens, the feasibility of zooming in and out of display, and the feasibility of displaying a predetermined image (a frame image) in the non-display area. Moreover, when the user selects a display method on the GUI screen, the display position information acquisition section 301 provides the display position generation circuit 309 with information indicating the display method selected by the user.

The LED output value calculation section 302 divides the timing-adjusted input image 31 provided by the drive timing alteration circuit 308 into a plurality of areas, and obtains LED data 34 indicating luminances upon emission of LEDs corresponding to the areas. At this time, the LED output value calculation section 302 sets values (LED output values) for luminances upon emission of LEDs corresponding to the non-display area to 0 (light off), on the basis of the masking filter 44 provided by the display position generation circuit 309.

In the present embodiment, the partial display correction filter 306 is generated on the basis of the display method selected by the user. In addition, the drive timing alteration circuit 308 outputs the input image 31 subjected to a timing adjustment based on the display method selected by the user, and the LED output value calculation section 302 and the display luminance calculation section 303 obtain display luminances 35 for each area. Thereafter, the LCD data calculation section 307 uses the input image 31, the display luminances 35, and the correction data 42 to calculate values of the liquid crystal data 36 by equation (1).

<3.2 Effect>

In the present embodiment, the masking filter 44 for turning off the non-display area is provided to the LED output value calculation section 302, on the basis of the display method selected by the user. Then, on the basis of the masking filter 44, the LED output value calculation section 302 sets values of luminances upon emission of LEDs corresponding to the non-display area to 0. As a result, the LEDs are lit up only within a range approximately equal to the display area when performing partial display. In addition, on the basis of the display method selected by the user, the partial display correction filter 306 having values of 1.0 or less stored therein as correction data 42 is generated, and when calculating the liquid crystal data 36, values of input data (pixel values of the timing-adjusted input image 31) are multiplied by the values of the correction data 42. As a result, overflow is inhibited from occurring when dividing values of input data by display luminance values, as in the first embodiment. Thus, low power consumption can be achieved in the display device which performs area-active drive without causing any display failure in performing partial display.

Furthermore, in the present embodiment, the drive timing alteration circuit 308, the display position generation circuit 309, and the display position information acquisition section 301 optimize driving of the panel in accordance with the display method selected by the user. Thus, lower power consumption can be achieved in the display device which performs area-active drive.

<3.3 Variant>

In the above embodiment, the masking filter 44 as shown in FIG. 28 is provided from the display position generation circuit 309 to the LED output value calculation section 302 when performing partial display, but the present invention is not limited to this. The masking filter 44 may be such that, for example as shown in FIG. 29, values in the four corners of the display area are 1.0, and the values decrease toward the center of the display area. In the case where the masking filter 44 shown in FIG. 29 is employed, as for the partial display correction filter 306, all values of correction data in the display area are set to 2.0, as shown in FIG. 30. In this case, to ensure necessary luminances at the edges of the display area, the overall luminance is reduced. For example, the maximum luminance within a portion which is not affected by the edges (typically, the center of the display area) is halved from the normal value. In this regard, in accordance with the size of a region where LEDs corresponding to the edges are lit up and the degree of a display failure at the edges, values of each filter, for example, may be adjusted while viewing the image on the display, such that the image is appropriately displayed. Note that in the case where the maximum possible luminance value at the edges of the display area is defined to be the maximum luminance value for each LED, and calculation is performed in such a way that a luminance value for a portion that is not affected by any edge is set to a maximum value (in the case where the partial display correction filter 306 is included in the LED output value calculation section 302), the display luminance calculation section 303 performs correction on the basis of the luminance spread filter 304 considering partial display, and therefore, the partial display correction filter generation section 305 and the partial display correction filter 306 are not required to be included.

<4. Fourth Embodiment>

<4.1 Configuration and Overview of the Operation>

Figure 31:
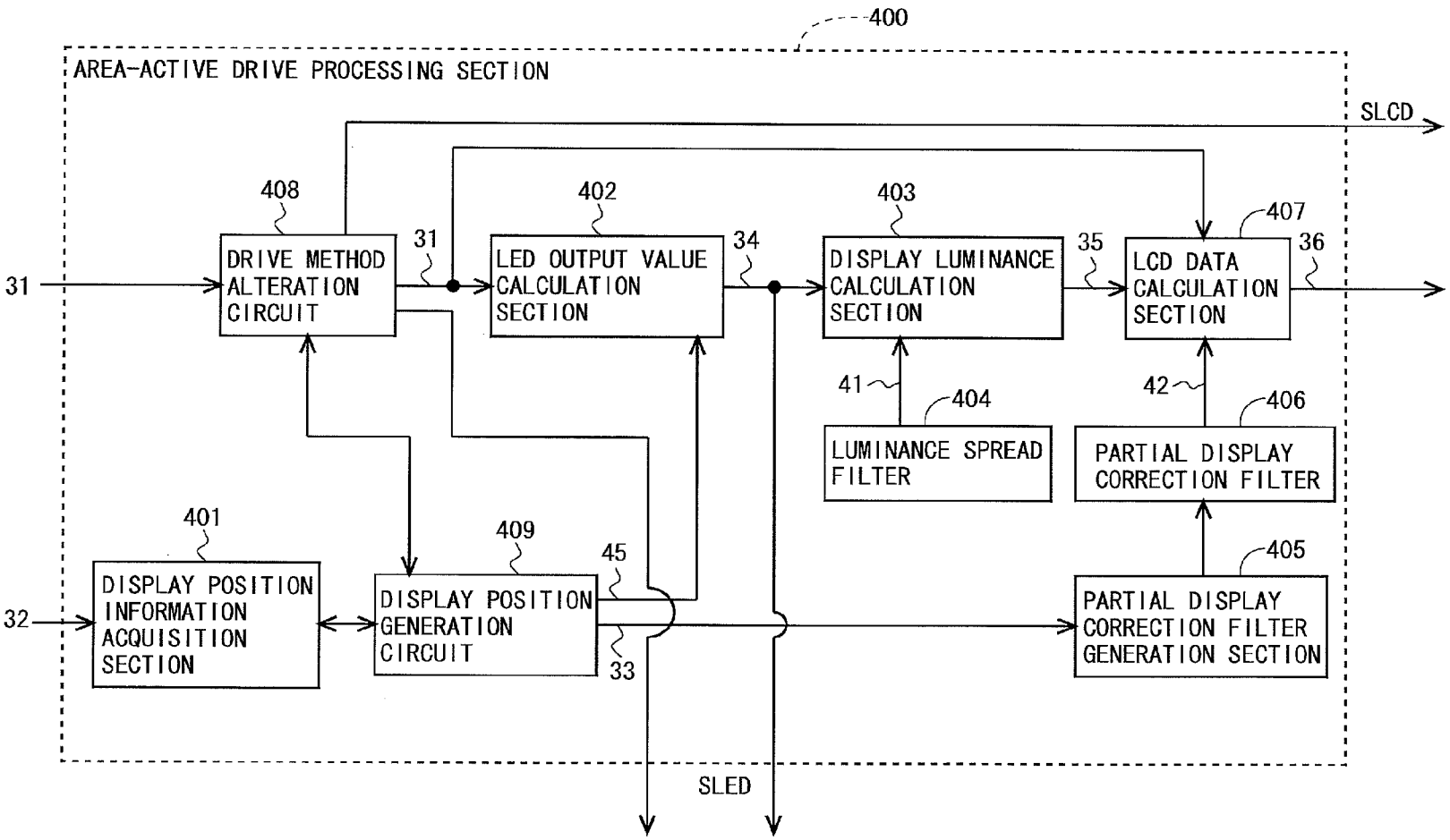
FIG. 31 is a block diagram illustrating a detailed configuration of an area-active drive processing section in a fourth embodiment of the present invention.

FIG. 31 is a block diagram illustrating a detailed configuration of an area-active drive processing section 400 according to a fourth embodiment of the present invention. Note that the overall configuration is the same as in the first embodiment, and therefore, any description thereof will be omitted. The area-active drive processing section 400 includes, as components for performing a predetermined process, a display position information acquisition section 401, a display position generation circuit 409, a drive method alteration circuit 408, an LED output value calculation section 402, a display luminance calculation section 403, a partial display correction filter generation section 405, and an LCD data calculation section 407 and also includes, as components for storing predetermined data, a luminance spread filter 404 and a partial display correction filter 406. Specifically, in the present embodiment, the drive method alteration circuit 408 is provided in place of the drive timing alteration circuit 308 in the third embodiment. Note that in the present embodiment, the LED output value calculation section 402 realizes an emission luminance calculation section, and the LCD data calculation section 407 realizes a display data calculation section, and the display position generation circuit 409 and the drive method alteration circuit 408 realize a drive control section.

The operations of the display luminance calculation section 403, the LCD data calculation section 407, and the partial display correction filter generation section 405, and the content of data stored in the luminance spread filter 404 and the partial display correction filter 406 are the same as in the first embodiment, and therefore, any descriptions thereof will be omitted. In addition, the operations of the display position information acquisition section 401, the display position generation circuit 409, and the LED output value calculation section 402 are the same as in the third embodiment, and therefore, any descriptions thereof will be omitted. Note that, instead of providing the masking filter 44 in the third embodiment, a filter (see FIG. 32) 45 having stored therein numerical data only for a portion corresponding to the display area is provided from the display position generation circuit 409 to the LED output value calculation section 402.

As in the third embodiment where the display method is determined by the input image 31, the drive timing alteration circuit 308, the display position information acquisition section 301, and the display position generation circuit 309, in the present embodiment, a display method is determined by the input image 31, the drive method alteration circuit 408, the display position information acquisition section 401, and the display position generation circuit 409. In accordance with the display method, the drive method alteration circuit 408 outputs the input image 31 subjected to a timing adjustment.

Furthermore, in accordance with the display method, the drive method alteration circuit 408 outputs an LCD control signal $S_{LCD}$, which controls the operation of the panel driver circuit 12 shown in FIG. 2, and an LED driver control signal $S_{LED}$, which controls the operation of the backlight driver circuit 14 shown in FIG. 2. As a result, in the panel driver circuit 12 and the backlight driver circuit 14, any components relevant to driving only the non-display area stop operating.

For example, in the case where a source driver for driving video signal lines is made up of four ICs (integrated circuits) in the panel driver circuit 12 and only one of the ICs is relevant to driving the display area, the other three ICs stop operating. Note that conceivable methods for stopping the components from operating include, but are not particularly limited to, stopping exchanging various signals and stopping the power supply to the component.

<4.2 Drive Example>

A drive example in the present embodiment will be described with respect to an operation of a display device of a high-resolution called "4K2K" (resolution: 3840×2160) when a full HD standard (resolution: 1920×1080) image (for one screen) is displayed.

First, a full HD standard input image 31 is provided to the drive method alteration circuit 408. After data is exchanged between the drive method alteration circuit 408 and the display position generation circuit 409 and data is exchanged between the display position generation circuit 409 and the display position information acquisition section 401, a screen for the user to select a display method is displayed on the GUI screen, which configures the display position information acquisition section 401. For example, once the user selects displaying a full HD standard image on the center of the screen, information indicating such content is sent from the display position information acquisition section 401 to the drive method alteration circuit 408 via the display position generation circuit 409.

On the basis of the information received from the display position information acquisition section 401, the display position generation circuit 409 provides a filter 45, as shown in FIG. 32, which corresponds to a full HD standard screen, to the LED output value calculation section 402 and provides display position identification data 33 to the partial display correction filter generation section 405. The partial display correction filter generation section 405 generates a partial display correction filter 406, as shown in FIG. 33, which corresponds to a full HD standard screen. On the basis of the information received from the display position generation circuit 409, the drive method alteration circuit 408 provides the input image 31 to the LED output value calculation section 402 and the LCD data calculation section 407, on the premise that full screen display based on full HD standard data is performed.

Furthermore, on the basis of the information received from the display position generation circuit 409, the drive method alteration circuit 408 provides the LCD control signal $S_{LCD}$ to the panel driver circuit 12 and provides the LED driver control signal $S_{LED}$ to the backlight driver circuit 14. As a result, in the panel driver circuit 12 and the backlight driver circuit 14, only the components for driving the center of the screen operate, and the components for driving the non-display area stop operating. Note that the configuration may be such that any component relevant to driving only the non-display area is stopped in either the panel driver circuit 12 or the backlight driver circuit 14.

<4.3 Effect>

In the present embodiment, the partial display correction filter 406 having values of 1.0 or less stored therein as correction data 42 is generated on the basis of the display method selected by the user, and when calculating the liquid crystal data 36, values of input data (pixel values of the input image 31) are multiplied by the values of the correction data 42. As a result, overflow is inhibited from occurring when dividing values of input data by display luminance values, as in the first embodiment. Moreover, in the present embodiment, any components relevant to driving only the non-display area stop operating in the panel driver circuit 12 and the backlight driver circuit 14 on the basis of the display method selected by the user. As a result, when performing partial display, LEDs are lit up only within a range approximately equal to the display area, and only the components for driving the display area operate in the panel driver circuit 12 and the backlight driver circuit 14. Thus, power consumption can be remarkably reduced in the display device which performs area-active drive.

<5. Automatic Correction Data Value Generation Process>

In the above embodiments, the partial display correction filter for use in calculating the liquid crystal data 36 is generated by the partial display correction filter generation section using predetermined values or selected from among a plurality of prepared filters by the partial display correction filter selection section, but the present invention is not limited to this. The configuration may be such that values of correction data to be stored in the partial display correction filter are automatically generated. Hereinafter, this will be described. Note that a process for automatically generating values of correction data, thereby generating a partial display correction filter is referred to as an "automatic correction data value generation process".

<5.1 First Example>

Figure 34:
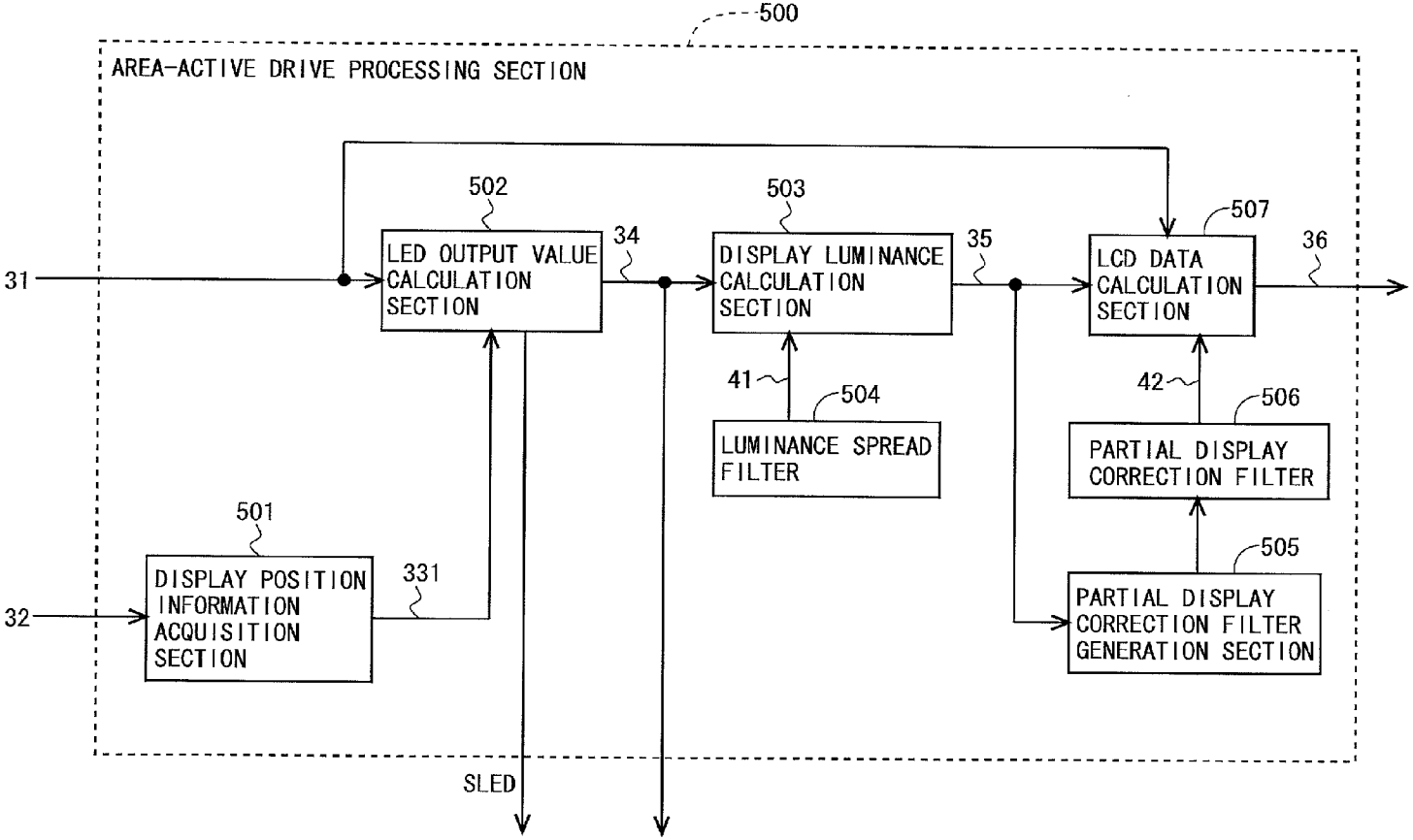
FIG. 34 is a block diagram illustrating a detailed configuration of an area-active drive processing section in an example (first example) where an automatic correction data value generation process is applied to the first embodiment.

Described first is a case where a component for the automatic correction data value generation process is additionally provided to the configuration according to the first embodiment. FIG. 34 is a block diagram illustrating a detailed configuration of an area-active drive processing section 500 in the present configuration example. In the present configuration example, unlike in the first embodiment, no display position identification data 33 is sent from the display position information acquisition section 501 to the partial display correction filter generation section 505. In addition, unlike in the first embodiment, display luminances 35 calculated for each area by the display luminance calculation section 503 are sent to the partial display correction filter generation section 505. Specifically, in the present configuration example, the partial display correction filter generation section 505 generates a partial display correction filter 506 on the basis of the display luminances 35 calculated by the display luminance calculation section 503. However, the partial display correction filter 506 is generated when there is a change in the display area as will be described below. In addition, although it has not been described in conjunction with the first embodiment (FIG. 1), the LED driver control signal $S_{LED}$ for controlling the operation of the backlight driver circuit 14 shown in FIG. 2 is outputted from the LED output value calculation section 502.

Figure 35:
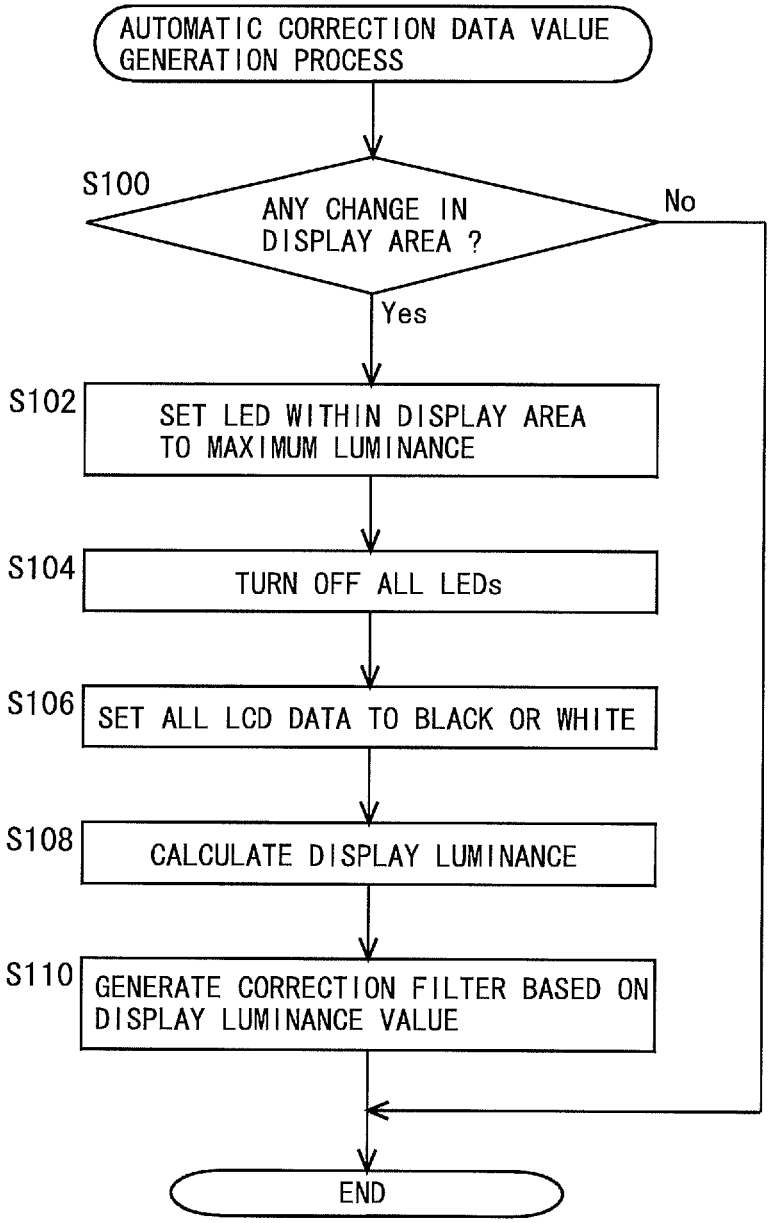
FIG. 35 is a flowchart illustrating the procedure of the automatic correction data value generation process in the first example.

FIG. 35 is a flowchart illustrating the procedure of the automatic correction data value generation process in the present configuration example. First, the display position information acquisition section 501 determines whether or not there is any change in the display area (step S100). If the result of the determination indicates no change in the display area, the automatic correction data value generation process ends without generating a new partial display correction filter 506. On the other hand, if there is any change in the display area, the process advances to step S102.

In step S102, data for causing the luminance upon emission of LEDs corresponding to the changed display area to be set to its maximum value is sent from the display position information acquisition section 501 to the LED output value calculation section 502 as pseudo-input data 331 to be used temporarily in place of the input image 31. Next, the LED output value calculation section 502 outputs an LED driver control signal $S_{LED}$ to turn off all LEDs, thereby stopping or resetting LED driving (step S104). That is, all LEDs are turned off.

Next, the LCD data calculation section 507 sets values of liquid crystal data 36 for all pixels to indicate black or white (step S106). Then, the display luminance calculation section 503 calculates display luminances 35 for each area on the basis of the pseudo-input data 331, and provides the display luminances 35 to the partial display correction filter generation section 505 (step S108). By the way, a filter made up of a collection of the display luminances 35 calculated by the display luminance calculation section 503 is a partial display correction filter suitable for the changed display. Therefore, the partial display correction filter generation section 505 generates a partial display correction filter 506 using the display luminances 35 calculated by the display luminance calculation section 503 (step S110). Thereafter, the automatic correction data value generation process ends, thereby returning to the normal display.

Figure 36:
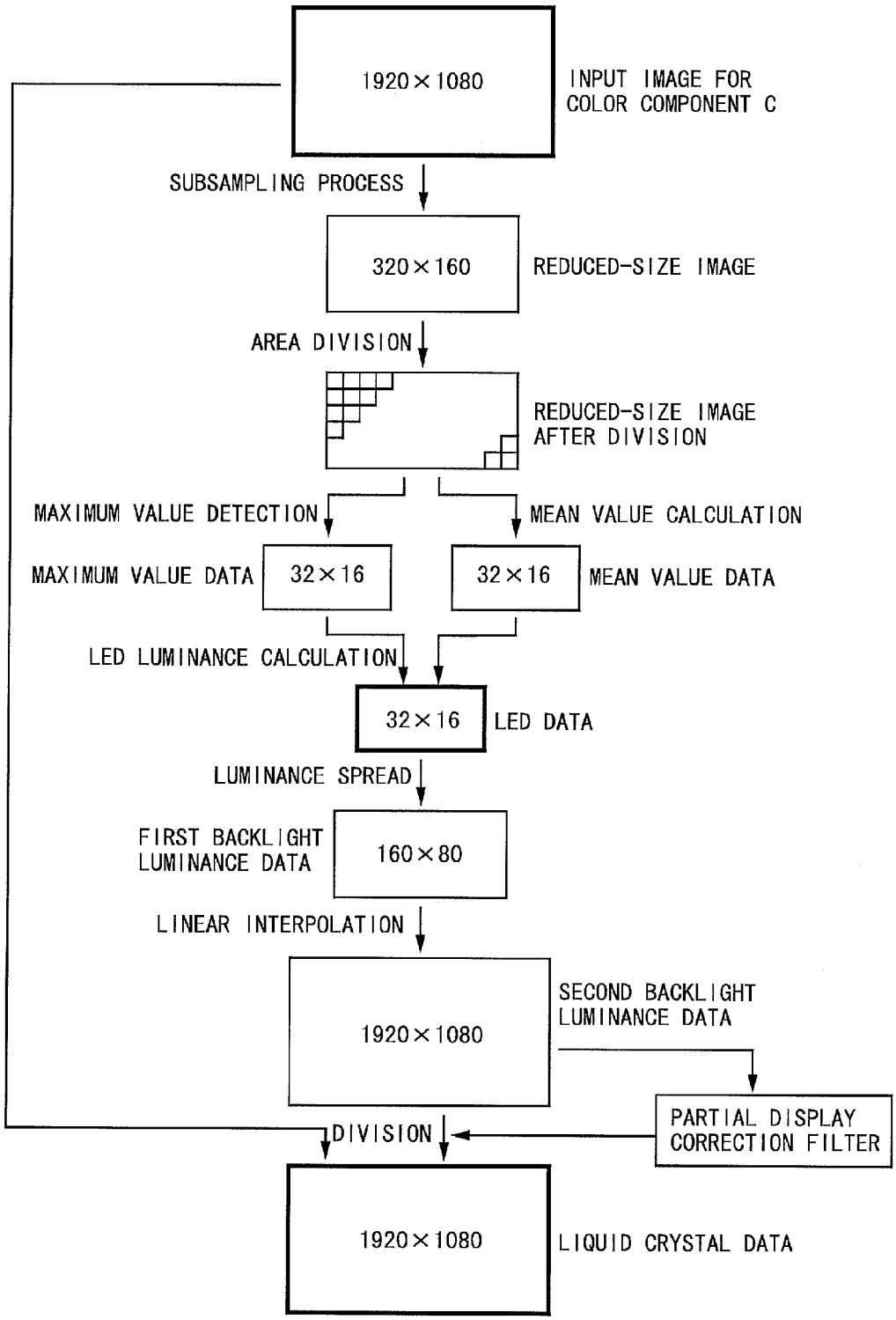
FIG. 36 is a diagram showing the course of action up to obtaining liquid crystal data and LED data in the first example.

Note that in the present configuration example, the size of the partial display correction filter 506 is equivalent to a total size of all pixels, as shown in FIG. 36. In addition, the configuration may be such that the masking filter (see FIG. 28) 44 in the third embodiment in place of the pseudo-input data 331 is provided from the display position information acquisition section 501 to the LED output value calculation section 502. Moreover, since the LEDs are turned off, the pseudo-input data 331 may be outputted as liquid crystal data 36 without modification. Thus, step S106 of FIG. 35 is no longer necessary, so that the circuitry for changing values of the liquid crystal data 36 is reduced.

<5.2 Second Example>

Figure 37:
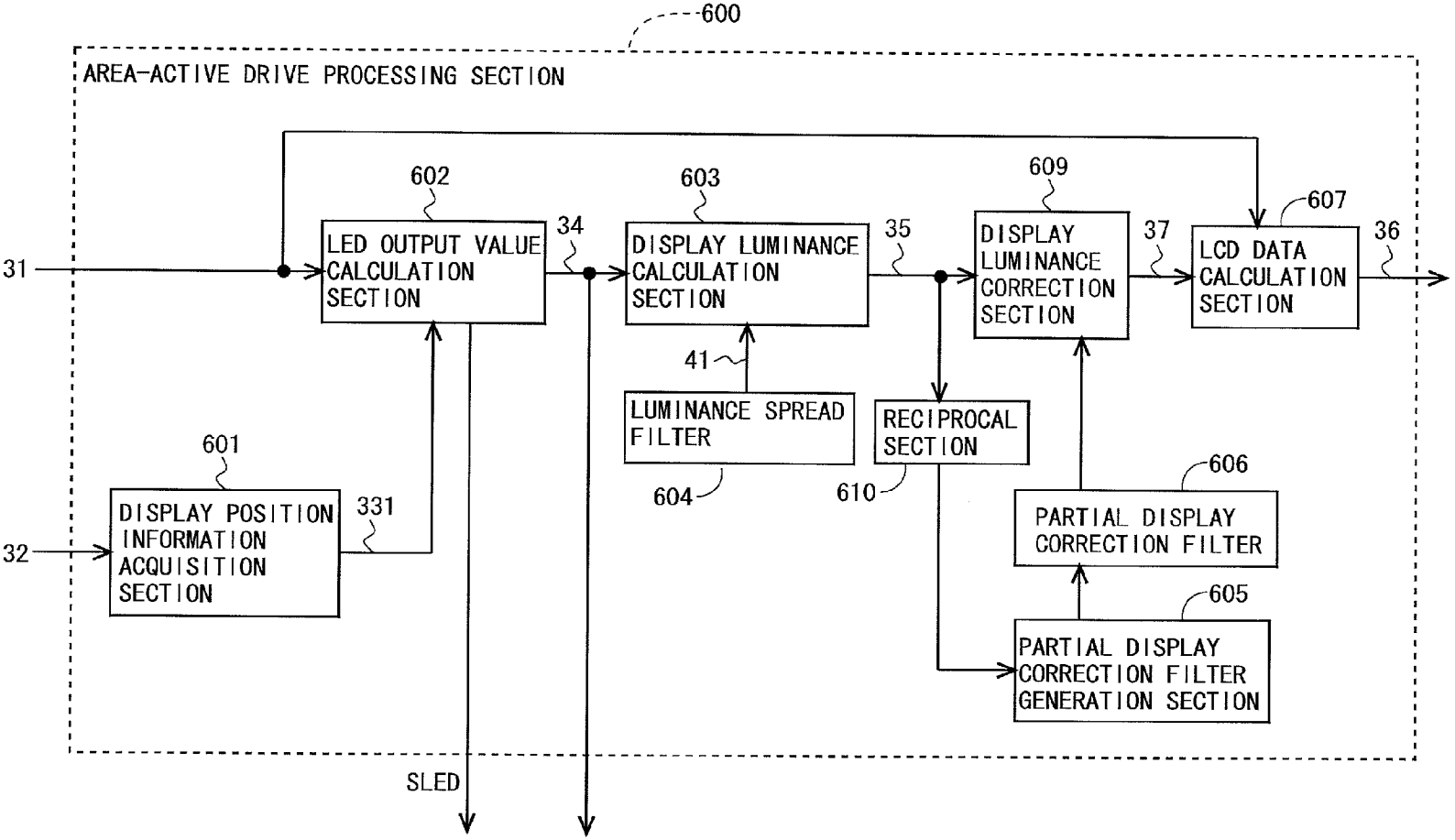
FIG. 37 is a block diagram illustrating a detailed configuration of an area-active drive processing section in an example (second example) where the automatic correction data value generation process is applied to the second embodiment.

Described next is a case where a component for the automatic correction data value generation process is additionally provided to the configuration according to the second embodiment. FIG. 37 is a block diagram illustrating a detailed configuration of an area-active drive processing section 600 in the present configuration example. In the present configuration example, unlike in the second embodiment, a partial display correction filter generation section 605 is provided. However, no display position identification data 33 is sent from the display position information acquisition section 601 to the partial display correction filter generation section 605. In addition, reciprocals of display luminances 35 calculated for each area by the display luminance calculation section 603 are sent to the partial display correction filter generation section 605 via a reciprocal section 610. Specifically, in the present configuration example, the partial display correction filter generation section 605 generates a partial display correction filter 606 on the basis of the reciprocals of the display luminances 35 calculated by the display luminance calculation section 603. However, as in the case of the first example, the partial display correction filter 606 is generated when there is a change in the display area.

Figure 38:
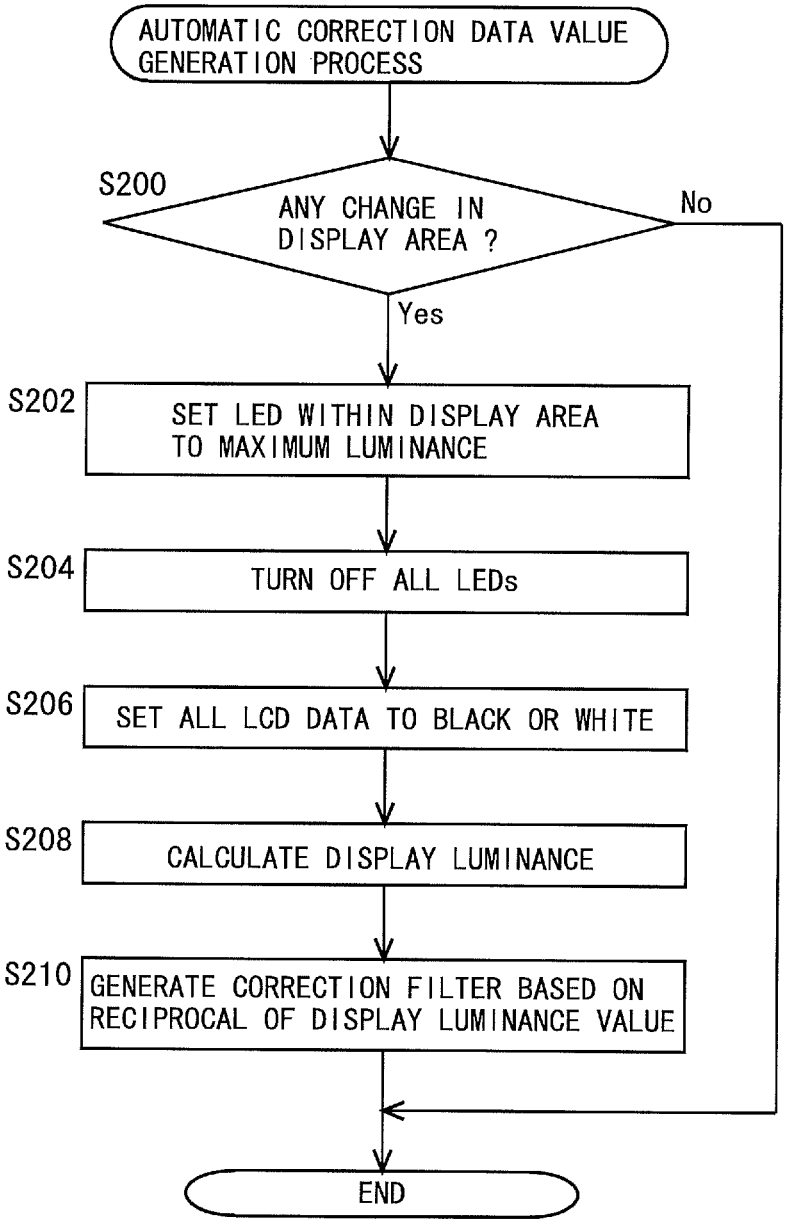
FIG. 38 is a flowchart illustrating the procedure of the automatic correction data value generation process in the second example.

FIG. 38 is a flowchart illustrating the procedure of the automatic correction data value generation process in the present configuration example. First, the display position information acquisition section 601 determines whether or not there is any change in the display area (step S200). If the result of the determination indicates no change in the display area, the automatic correction data value generation process ends without generating a new partial display correction filter 606. On the other hand, if there is any change in the display area, the process advances to step S202. Insteps S202 to S208, similar processing to that in steps S102 to S108 of the first configuration example is performed.

After step S208, the partial display correction filter generation section 605 generates a partial display correction filter 606 using reciprocals of display luminances 35 calculated by the display luminance calculation section 603 (step S210). Thereafter, the automatic correction data value generation process ends, thereby returning to the normal display.

Figure 39:
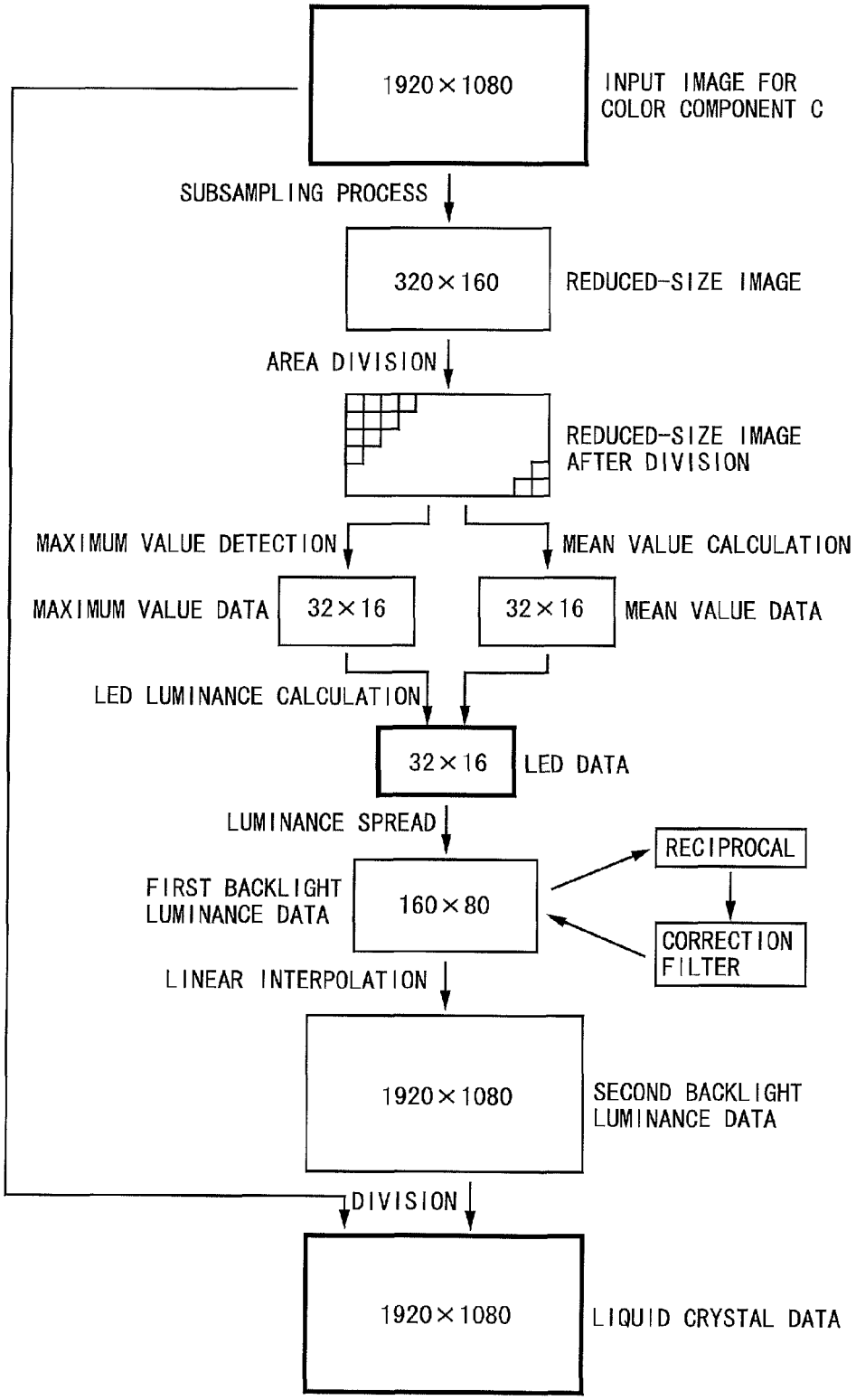
FIG. 39 is a diagram showing the course of action up to obtaining liquid crystal data and LED data in the second example.

Note that in the present configuration example, the size of the partial display correction filter 606 is the size of data obtained by luminance spread, as shown in FIG. 39. In addition, the configuration may be such that the masking filter (see FIG. 28) 44 in the third embodiment in place of the pseudo-input data 331 is provided from the display position information acquisition section 601 to the LED output value calculation section 602.

<5.3 Effect>

As described above, according to the automatic correction data value generation process, a partial display correction filter to be calculated by the LCD data calculation section when performing partial display is automatically generated without holding values of correction data to be stored in the partial display correction filter in advance. In addition, when the partial display correction filter is generated, all LEDs are turned off. Thus, it is possible to prevent the screen from being lit up momentarily in white when the display area changes.

Description Of The Reference Characters

10 liquid crystal display device
11 liquid crystal panel
12 panel driver circuit
13 backlight
14 backlight driver circuit
21 display element
31 input image
32 display position information
33 display position identification data
34 LED data
35 display luminance
36 liquid crystal data
41 PSF data
42 correction data
100 area-active drive processing section
101 display position information acquisition section
102 LED output value calculation section
103 display luminance calculation section
104 luminance spread filter
105 partial display correction filter generation section
106 partial display correction filter
107 LCD data calculation section

The invention claimed is:

1. An image display device provided with a display panel including a plurality of display elements, the device having a full display function for displaying an image based on an externally provided input image on the entire display panel and a partial display function for displaying an image based on the input image in a partial region of the display panel, the device comprising:

a backlight including a plurality of light sources;

an emission luminance calculation section for dividing the input image into the same number of areas as the light sources and obtaining an emission luminance which is a luminance upon emission of the light source corresponding to each area;

a display luminance calculation section for calculating a display luminance for each area on the basis of the emission luminance of the light source corresponding to that area and emission luminances of light sources corresponding to predetermined areas surrounding that area, the display luminance being a luminance achievable upon display in that area;

a display position information acquisition section for acquiring display position identification data to identify a display region in which the image based on the input image should be displayed when performing partial display;

a correction filter having correction values stored therein in association with the areas or the display elements, the correction values being values determined in accordance with the display region identified by the display position identification data;

a display data calculation section for calculating display data for controlling a light transmittance of each display element, on the basis of the input image, the display luminance, and the correction values stored in the correction filter;

a panel driver circuit for outputting a light transmittance control signal for controlling the light transmittance of each display element to the display panel, on the basis of the display data; and a backlight driver circuit for outputting a luminance control signal for controlling the luminance of each light source to the backlight, on the basis of the emission luminance, wherein when the display luminance corresponding to an arbitrary display element is 0, the display data calculation section sets the value of the display data for the display element to 0, and when the display luminance corresponding to the display element is not 0, the display data calculation section calculates the value of the display data for the display element by dividing a product of a pixel value of the input image and the correction value by the display luminance or by dividing the pixel value of the input image by a product of the display luminance and the correction value.

2. The image display device according to claim 1, further comprising:

a correction filter selection section for selecting a correction filter to be referenced by the display data calculation section from among a full display filter and one or more partial display filters, which are prepared as the correction filters, on the basis of the display position identification data.

3. The image display device according to claim 1, further comprising:

a correction filter generation section for generating the correction filter, wherein when there is a change in the display region identified by the display position identification data, the emission luminance calculation section calculates the emission luminance of the light source corresponding to each area, such that emission luminances of light sources corresponding to the display region after the change are set to a maximum possible luminance value for the light sources, and emission luminances of light sources corresponding to a non-display region after the change are set to a minimum possible luminance value for the light sources, and the correction filter generation section generates the correction filter by setting the display luminance calculated by the display luminance calculation section as the correction value without modification.

4. The image display device according to claim 3, wherein, when there is a change in the display region identified by the display position identification data, the backlight driver circuit outputs the luminance control signal such that all of the light sources are turned off.

5. The image display device according to claim 1, further comprising:

a drive control section for providing the input image to the emission luminance calculation section at different times in accordance with the display region identified by the display position identification data, such that the panel driver circuit and the backlight driver circuit operate in accordance with the display region.

6. The image display device according to claim 5, wherein, when the input image has a lower resolution than the display panel in performing partial display, the drive control section provides the input image to the emission luminance calculation section with the timing for full display.

7. The image display device according to claim 1, wherein, in performing partial display, a frame image is displayed in a non-display region, the frame image being a prepared image.

8. The image display device according to claim 1, wherein, when there is a change in the display region identified by the display position identification data, the display data calculation section sequentially refers to three or more correction filters over time between before and after the change, such that an image displayed on the display panel gradually changes, the filters having stored therein their respective different patterns of correction values.

9. An image display method in an image display device provided with a display panel including a plurality of display elements and a backlight including a plurality of light sources, the device having a full display function for displaying an image based on an externally provided input image on the entire display panel and a partial display function for displaying an image based on the input image in a partial region of the display panel, the method comprising:

an emission luminance calculation step for dividing the input image into the same number of areas as the light sources and obtaining an emission luminance which is a luminance upon emission of the light source corresponding to each area;

a display luminance calculation step for calculating a display luminance for each area on the basis of the emission luminance of the light source corresponding to that area and emission luminances of light sources corresponding to predetermined areas surrounding that area, the display luminance being a luminance achievable upon display in that area;

a display position information acquisition step for acquiring display position identification data to identify a display region in which the image based on the input image should be displayed when performing partial display;

a display data calculation step for calculating display data for controlling a light transmittance of each display element, on the basis of correction values, the input image, and the display luminance, the correction values being values determined in accordance with the display region identified by the display position identification data and being stored in a predetermined correction filter in association with the areas or the display elements;

a panel drive step for outputting a light transmittance control signal for controlling the light transmittance of each display element to the display panel, on the basis of the display data; and a backlight drive step for outputting a luminance control signal for controlling the luminance of each light source to the backlight, on the basis of the emission luminance, wherein when the display luminance corresponding to an arbitrary display element is 0, in the display data calculation step, the value of the display data for the display element is set to 0, and when the display luminance corresponding to the display element is not 0, in the display data calculation step, the value of the display data for the display element is calculated by dividing a product of a pixel value of the input image and the correction value by the display luminance or by dividing the pixel value of the input image by a product of the display luminance and the correction value.

10. The image display method according to claim 9, further comprising:

a correction filter selection step for selecting a correction filter to be referenced in the display data calculation step from among a full display filter and one or more partial display filters, which are prepared as the correction filters, on the basis of the display position identification data.

11. The image display method according to claim 9, further comprising:

a correction filter generation step for generating the correction filter, wherein when there is a change in the display region identified by the display position identification data, in the emission luminance calculation step, the emission luminance of the light source corresponding to each area is calculated, such that emission luminances of light sources corresponding to the display region after the change are set to a maximum possible luminance value for the light sources, and emission luminances of light sources corresponding to a non-display region after the change are set to a minimum possible luminance value for the light sources, and in the correction filter generation step, the correction filter is generated by setting the display luminance calculated in the display luminance calculation step as the correction value without modification.

12. The image display method according to claim 11, wherein, when there is a change in the display region identified by the display position identification data, the luminance control signal is outputted in the backlight drive step, such that all of the light sources are turned off.

13. The image display method according to claim 9, wherein, in performing partial display, a frame image is displayed in a non-display region, the frame image being a prepared image.

14. The image display method according to claim 9, wherein, when there is a change in the display region identified by the display position identification data, three or more correction filters are sequentially referenced in the display data calculation step over time between before and after the change, such that an image displayed on the display panel gradually changes, the filters having stored therein their respective different patterns of correction values.

* * * * *